US007431671B1

(12) United States Patent
Frost

(10) Patent No.: US 7,431,671 B1
(45) Date of Patent: Oct. 7, 2008

(54) HAND ACCESSORY USABLE WITH AN IMPLEMENT HANDLE

(76) Inventor: John H. Frost, 23520 Califa St., Woodland Hills, CA (US) 91367

( * ) Notice: Subject to any disclaimer, the term of this patent is extended or adjusted under 35 U.S.C. 154(b) by 368 days.

(21) Appl. No.: 11/373,004

(22) Filed: Mar. 10, 2006

Related U.S. Application Data

(63) Continuation-in-part of application No. 11/115,805, filed on Apr. 26, 2005, now Pat. No. 7,179,180.

(51) Int. Cl.
*A63B 69/00* (2006.01)

(52) U.S. Cl. ..... 473/458; 473/206; 2/20

(58) Field of Classification Search ..... 473/458, 473/206, 451; 2/20
See application file for complete search history.

(56) References Cited

U.S. PATENT DOCUMENTS 1,200,580 A * 10/1916 Brenner ..... 2/161.3
1,690,312 A * 11/1928 Rosan ..... 473/206
2,710,190 A * 6/1955 Schimansky ..... 473/206
2,962,288 A * 11/1960 Lowden ..... 473/206
3,606,614 A * 9/1971 Dimitroff ..... 2/159
4,461,043 A * 7/1984 Lomedico ..... 2/21
4,836,544 A * 6/1989 Lai ..... 473/551
5,069,454 A * 12/1991 Frost ..... 473/206
5,180,165 A * 1/1993 Frost ..... 473/206
5,322,286 A * 6/1994 Frost ..... 473/568
5,588,651 A * 12/1996 Frost ..... 473/206
5,704,845 A * 1/1998 Boyte ..... 473/205
7,179,180 B1 * 2/2007 Frost ..... 473/458

* cited by examiner

*Primary Examiner*—Gene Kim
*Assistant Examiner*—M Chambers
(74) *Attorney, Agent, or Firm*—Jack Munro; Sandy Lipkin

(57) ABSTRACT

A hand accessory contoured to anchor into tough areas of a hand and bridge over sensitive areas in securing a grip on an implement handle, maximizing the transmission of force to the implement handle, minimizing stress received in the sensitive areas of the hand (primarily the upper areas) and increasing power transmission through tougher and stronger areas of the hand (primarily the lower areas).

29 Claims, 16 Drawing Sheets

HAND ACCESSORY USABLE WITH AN IMPLEMENT HANDLE

REFERENCE TO PRIOR APPLICATION

This application is a continuation-in-part of U.S. patent application Ser. No. 11/115,805, now U.S. Pat. No. 7,179,180 filed Apr. 26, 2005, by the present inventor.

BACKGROUND OF THE INVENTION

1. Field of the Invention

The field of this invention relates generally to hand accessories useful for improving power transmission and improving the gripping movement of the hands of a human in connection with the handle of an implement, such as a baseball bat, thereby transmitting a greater amount of power and control of flight to a baseball that is struck with the baseball bat.

2. Description of the Related Art

The subject matter of the present invention is an improvement over the structure defined within CIP patent application Ser. No. 11/115,805, filed Apr. 26, 2005, entitled HAND ACCESSORY USABLE WITH AN IMPLEMENT HANDLE, U.S. Pat. No. 5,180,165, issued Jan. 19, 1993, entitled HAND ACCESSORY, and U.S. Pat. No. 5,588,651, issued Dec. 31, 1996, entitled HAND ACCESSORY FOR SWINGING AN IMPLEMENT HANDLE, both invented by the present inventor, and all designed to enhance the user's gripping and/or swinging strength primarily in conjunction with a baseball bat, but also with any other round, thin handle, such as a weight lifting bar, tool, bicycle or steering wheel.

The structure of the present invention allows for a more relaxed grip on the implement handle, provides greater leverage and power, reduces stress to the hand, and also protects the hand from stinging and bruising when the implement, such as a bat, makes contact with an object, such as a ball.

One of the objectives of the hand accessory of the present invention is to bridge over sensitive areas (bones and tendons) within the user's hands by positioning contact points in the tough fleshy areas of the hands to 1) absorb energy and 2) support the bridges. Of great importance, the bridges connecting these contact points need to flex through a certain necessary range of hand movement during the swing, and this last requirement has been the most challenging because areas in the hand move in opposite directions to each other, and in the case of top hand grip of a bat, change directions during the gripping motion. To clarify, power from the body must flow through the hands and overcome the inertial "recoil" force of the bat against the hands during the swing, so "absorbing energy" means channeling force from the recoiling handle to not only tougher but stronger areas of the hand. (The terms, "absorbing energy or stress" from the handle and "transmission of power" from the hands are mostly interchangeable, just thought of separately depending on the objective.)

The inventor's early patents described "plugs" which were to fill certain fleshy or hollow areas of the hands in an attempt to prevent the handle from recoiling by inertia out of its proper finger grip, in other words, to support the handle. It became apparent however, that simply filling certain areas was not enough and that the structure, now more aptly described as a "bridge" or a "lever", needs to work in conjunction with certain specific movements of the hand in order to leverage (rather than block by filling) the implement handle into a more powerful position. Because the hands are not static during the swing, the hand accessory needs to be flexible, yet still hold the handle away from the bridged over sensitive areas, which has been the great difficulty in prior art devices.

It is to be understood that all the following claims of benefits includes reduction of stress to the fingers, since stress reduction to the fingers has been accomplished in all the inventor's prior patents by supporting the handle in various ways. Therefore, the following claims and objectives include reduction of stress to the fingers.

The task has been to channel stress to, and harness and direct power from, the tough, fleshy and stronger areas during the squeezing swinging motion of the implement handle. Whenever enough material was used to support the handle in its proper finger grip position, the hand accessory became "bulky" in most pro batter's description. While some high school players have used it satisfactorily in the playing of baseball, its performance previously was not up to pro standards.

Despite discomfort and an unnatural feeling, why would "too bulky" be a detriment to swinging a baseball bat? The answer was originally thought to be simply that the hand is composed of so many sensitive areas (bones and tendons), that it was nearly impossible to contact the tough areas (muscle and fleshy areas) without affecting these sensitive areas, so the hand accessory would have to be very specific with many different angles, and no matter how much smoothing or reducing of material in the sensitive areas, it was not satisfactory unless the tough, adjacent areas nearby (sometimes within one-sixteenth of an inch) were contacted to hold the structure against the force of the recoiling baseball bat handle away from the sensitive areas. It was determined from testing that any impingement of the bony/tendon areas caused a reduction in bat speed.

It was found, however, that sensitivity was not the only problem of "too bulky". If only the tough/fleshy areas were contacted (eliminating discomfort), but with too much bulk, it was again found that bat speed was lost, thus leading to the conclusion that obstruction of most areas of the hand's normal movement in gripping led to a loss of power. But the attempted solution of reducing the thickness of those areas would again allow the handle (bat) to press too hard, collapsing the material bridging the sensitive areas, which brings us back to the sensitivity problem, a circular dilemma. The objective was to find a way to obtain flexibility so that the hand could move through its necessary gripping motion, yet the tough areas be contacted and connected in such a manner as to avoid stress to the sensitive areas of the hands and receive uniform stress in the tough "power areas". The present invention actually modifies the grip, limiting the forward motion of the thumb area (see summary and specification).

The hand accessory of the present invention uses many of the same areas of contact as in the previously described patents. However, the material connecting these contact areas has changed significantly, allowing for the necessary hand range of motion. There has also been new structure discovered both for anchoring and for bridging over sensitive areas, to broaden both the areas of absorption of stress from the handle and areas of transmission of power by the hands. More importantly, the contact area between the handle and the exterior surface of the hand accessory has changed significantly, its position and its angle being crucial in channeling stress from the recoiling handle not only to tough areas, but stronger areas which exist in the lower areas of the hand, especially the lower tough ball, wrist and lower web.

The prior art all showed a somewhat concave exterior contacting the handle, with a convex interior filling the hand. An important change in all the embodiments of the present invention is the arcing, mostly convex exterior surface, highlighted by a "bridge" which leverages the handle away from sensitive areas of the hand.

An important recent development is a means of connecting structure in the upper area of the hand with structure in the lower area to harness power from the lifeline, web and thumb base without discomfort or stress in the thumb and upper areas of the hand. GRIP ANALYSIS WITHOUT USE OF A HAND ACCESSORY:

For clarity, a distinction shall be made between at least three phases of the grip of the top hand during the swinging of a baseball bat, and two phases in the bottom hand. TOP HAND: In phase one, or "ready grip", the hand is relaxed with the handle located in a "finger grip" but not necessarily in the index finger, since it is primarily the little, ring, and middle fingers which generate bat speed (The little and ring finger hereinafter referred to as "lower fingers"). In phase two, the swing is initiated with the hand beginning to tighten and "tuck" under the handle led by the tough ball area. The phase three or "full squeeze" grip finds the hand reversing upwardly, and "locking" at its fullest tightened position (as explained later, that position is modified by hand accessory 400). Phase two and three are explained more fully below.

BOTTOM HAND: There is far less movement in the bottom hand, with the handle located more in the palm than out in the fingers, the hand pivoting (closing) more below the knuckles than above the knuckles creating a rounder grip and more "hollow" palm (more space), the thumb reaching further downward, never reversing upwardly, having still greater effect of creating a more "hollow palm" than in the top hand. The hollow palm described above creates a loss of contact, a weakness that flared handles attempt to overcome, but the main problem is discomfort from the knob moving into the metacarpal area of the hand which can cause bruising and loss of accuracy in the swing. These problems have been overcome by the current embodiment 400.

Top hand clarification for a right hand hitter: With the handle held by the fingers outwardly against the knuckles, the inward area of the hand (including the tough ball and thumb base) pivots downward during phase two (like a door on a loose hinge hanging down angling away from the top of the door jam) the downward pivoting being allowed primarily due to flexibility at the knuckle joints and caused by the handle's parallel position to the ground recoiling toward the upper area of the hand, thus, the phase two "tucking" motion as the elbow of the batter draws in toward the ribs creating a slight clockwise motion of the hand with the knuckles also moving downward and toward the handle gaining more handle support and also moving into a more "cocked" position (top of hand angled back), phase two generating the majority of the power (bat speed). In phase three, the hand uncocks and moves forward, as the lower fingers tighten moving relatively toward the batter still generating bat speed while the thumb reverses direction moving upward and outward (away from the batter) attempting to direct the handle for accuracy (bat speed having already been generated), now creating a slightly counterclockwise rotation, the opposite of phase two, whereby the upper knuckles move away from the handle and the thumb moves toward the handle reducing space for the handle within the palm and creating possible bruising to the thumb second joint. At the end of phase three, there is little space left for any hand accessory material, and this is where the greatest stress occurs to the hand (without hand accessory) whether ball contact is made or not, as the handle is moving relatively toward the forward moving upper area of the hand, and the counterclockwise rotation drawing the thumb second joint nearer to the handle.

The lack of space during phase three of the top hand, created a continual dilemma until the latest discoveries were made which shall be claimed in this current invention. Another problem not completely overcome until the most recent hand accessory 400, is that while the handle in phase one is in an angle perpendicular to the ground, after the "tuck" during phase two and through phase three the hands and handle angle parallel to the ground, the lower portion of the hand traveling ahead of the upper portion of the hand, which causes the handle by inertia to force and move the hand accessory towards the upper area of the hand causing stress in that area. Testing the hand accessory by just holding the bat vertically and rocking it back and forth would often feel good, but then swinging the bat (such as in a batting cage) would cause discomfort and loss of power due to movement of the hand accessory out of its proper position even though attached to a tight fitting glove. Inertial movement of the hand accessory towards the upper area of the hand was reduced with the addition of the large, wrapping tough ball anchor found in embodiment 203. Further stabilization was accomplished in embodiment 300 such that the main stress receiving area was no longer in the weaker, more sensitive upper area, and current embodiment 400 with improved structure in the upper areas of the hand, channeling the majority of stress to lower, tougher areas of the hand, now is able to absorb a significant amount of stress at the lifeline and web areas without impingement or buckling problems.

SUMMARY OF THE INVENTION

The most recent embodiment and primary structure of this invention for which the claims are directed is seventh embodiment 400 of hand accessory. A summary description of prior embodiments is not included with the summary concentrating solely on this seventh embodiment.

It is to be understood that because the hand accessory is fixed within an external glove, any portion of the hand accessory may be removed, while the remaining portion is held in proper mounting position by the glove. Thus, the upper hand anchor may be used independently for thumb bone protection, the lower (tough ball) anchor may be used independently for increased power, or the two may function together but separated, attached in the mid-palm area only by the leather or other material of the external glove.

The seventh embodiment 400 of hand accessory (FIGS. 27-35) of this invention improves primarily the area of the sixth embodiment 300 lifeline anchor 320 (now upper hand anchor 420) with new structure "locking" into the hand's lifeline/web portions 36, 32 and 46 more securely, channeling force to the tough ball anchor 410 (in the lower hand) through a mid-palm anchor 415 providing more stability than swivel 330, and increasing the amount of protection from bruising of the thumb (second) joint by at least five combined means, still without covering the thumb joint or adding bulky material which would increase stress to the upper area of the hand. (Important reminder: Stress and bruising are two different concepts in this and previous embodiments. Products which cover the thumb joint with a "cushion" reduce bruising but increase stress to the hand. Current embodiment 400 reduces both bruising and stress.)

The sixth embodiment 300 had good acceptance by baseball players especially in the bottom hand, however most were still looking for more protection from bruising in the thumb joint area of the top hand, so the current inventor once again sought to add structure in the hand's web area, a task with many obstacles as explained in previous embodiments and patents. It has been found that a thin strip, web anchor 418, with perfect size and placement along the intersection of upper web 46 and transverse crease 10 provides a comfortable means of connecting to and better utilizing certain types of surrounding structure creating an arrangement workable for all types of griping, both top and bottom hands. See FIGS. 27 and 28. The connection of web anchor 418 to mid-palm anchor 415 at web relocation press 419, and to thumb/handle spacer 416 at upper web relocation press 417, does not block or impinge on the necessary movement of the thumb, and does not create buckling when hand space lessens during gripping. The above combined structures 1) act as a cushion to handle 48, 2) brace thumb movement away from handle 48, 3) contact and leverage handle 48 toward the fingers, 4) allow more power to be harnessed as the thumb base travels forward in a wider, more circular path transferring more power to tough ball anchor 310 while providing more lower web space for anchoring without impinging on the thumb bone or index finger tendon, and 5) of great importance and accomplishment, press into lower web 32 and upper web 46 relocating the fleshy web area in two directions, 1) bulking the hand's lower fleshy web 32 (relocated lower web 32A) against and partially over the sensitive thumb joint 34 (FIGS. 30 and 33) and 2) bulking upper web 46 (relocated upper web 46A) under web anchor 418 (FIGS. 29 and 33) such that the web itself provides cushion and protection and in combination with the other features prevention of bruising.

The basic features of tough ball anchor 410 remain the same as in tough ball anchor 310, the main difference being an upper area of the bridge 440 which becomes mid-palm anchor 415 connecting to upper hand anchor 420 in the area of sixth embodiment disconnect space 343, eliminating the need for swivel 330. Previous problems encountered by connecting the bridge 440 directly to upper hand anchor 420 (previously lifeline anchor 320) have been overcome by the above described structure in combination with the structure of the mid-palm and lower hand allowing full downward movement of thumb base 30 without dislodging anchoring in the lifeline/web areas 36 and 32, plus mid-palm anchor 415 having "eggshell" type strength and filling fully the hand's lifeline partially by bending into it at lifeline/web anchor 425 when the hand grips such that material filling the hand's lifeline/web 32 is not so readily apparent visibly, but rather is felt pressing into and "filling" lower web 32 during the grip, the sensation and reality being of the hand expanding, becoming wider and stronger. Bridge 440 angles interiorly at bridge/palm angle 441 arcing concavely becoming mid-palm anchor 415 at thumb base/lifeline anchor 452 which presses flush with the hand such that the gripping motion moves the hand's mid-palm skin downwardly adding bulk to tough ball areas 38 and 39 and pushing bridge 440 exteriorly providing more support to handle 48, that area of bridge 440 (below bridge/palm angle 441) reversing direction from mid-palm anchor 415 arcing exteriorly from the hand (widthwise) as lever 408 (FIG. 30). Lever 408, between bridge/palm angle 441 and fulcrum platform 402 is now more clearly defined than in embodiment 300, with sharper delineation at upper and lower junctions, lever 408 extending from primary contact point 406 to tough ball anchor 450 clearly arcing exteriorly as a lever (lengthwise) against handle 48 (FIG. 29). (Lever 408 arcs three ways exteriorly lengthwise and widthwise, and upwardly (interiorly) lengthwise (FIG. 28) explained in the detail.) Highly important, tough ball anchor 410 is constructed such that a natural phase two grip occurs, limiting completion of phase three.

Unlike the anchoring areas, thumb/lifeline buffer 448 does not "lock" into the hand, rather it allows the hand's upper thumb base 31 to slide forward slightly (see thumb/wedge 234, fifth embodiment 200) while pressing thumb/lifeline buffer 448 externally acting as a buffer for bony lifeline anchor 451 by receiving some of the stress in that area. To better explain, power is gained by the hand's lifeline 36 "locking" into lifeline anchors 452 and 451, which arc snugly into the hand's palm and lifeline; the bony lifeline anchor 451 however, being in a more sensitive area than the upper more fleshy areas, gains the perfect amount of contact/pressure with the slight support of thumb/lifeline buffer 448 at upper thumb base 31 which is angled to allow thumb base 30 full downward movement so mid-palm anchor 415 is not pushed out (externally) of its snug anchoring position. Thus support for bridge 440 is gained in the mid-upper hand areas from mid-palm anchor 415 and more specifically from lifeline/web anchor 425, thumb base/lifeline anchor 452, bony lifeline anchor 451, thumb base/wrist anchor 450 and somewhat from thumb/lifeline buffer 448 and wrist anchor 449.

The greatest stress receiving are of bridge 440 is still primary contact point 406 which at the outer area of lever 408 has a more defined, flatter receiving area than embodiment 300. Fulcrum platform 402 of tough ball anchor 410 with ridge 404 pressing into and relocating the hand's lower tough ball 39 as repositioned fleshy ridge 14 (FIG. 32) is still probably the strongest supporting anchor for bridge 440, however ridge 404 has been re-angled, arcing against lower tough ball 39 in such a manner that ridge lock 303 and fulcrum junction 305 as specific structure have been eliminated, but their purposes still accomplished with ridge 404 acting as a fulcrum for lever 408 primarily at its highest arcing point ridge fulcrum 403, and the "pinching off"/blocking of bank 13 of fleshy ridge 14 accomplished adequately by handle 48 pressure over a narrowed portion of fleshy relocation channel 409 while still allowing hand movement through the powerful phase two/early phase three portion of the gripping motion.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Note: Because descriptions of hand areas and descriptions of the hand accessory structure are similar and may be confusing to the reader, hand descriptions will often by preceded by "the hand's . . . ", such as "the hand's lifeline 36" so as not to confuse with "lifeline anchor 88".

Figure 1:
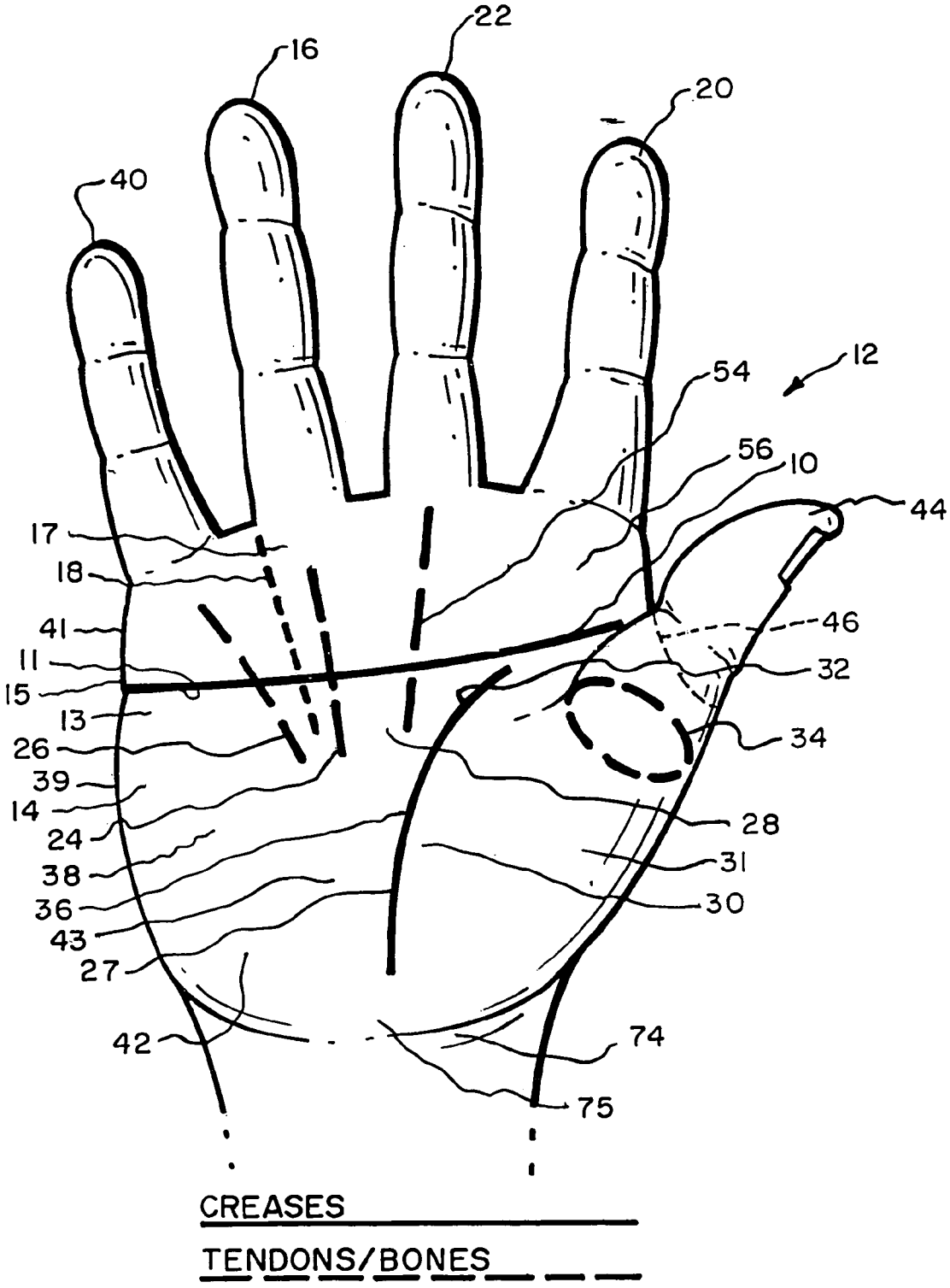
FIG. 1 is a diagrammatic depiction of a human hand depicting the different areas of the hand that the hand accessories of the present invention works in conjunction.

The material of construction of all hand accessory embodiments will normally be of semi-rigid rubber. For directional purposes, the area of each hand accessory defined as the upper, lower, outward (or forward) and inward, shall be used to apply to coinciding areas of the hand (see FIG. 1), the upper hand including the lower web 32 and thumb base 30, the lower hand extending from the wrist hollow 75 to the little finger knuckle 41 and including the tough ball 38 lower tough ball 39 and fleshy heel 42. The mid-palm 28 lies midway between the upper hand and lower hand. The outward direction (or forward) would be toward the fingers 40, 16, 22 and 20. The inward direction would be toward the wrist 74.

Outward of the mid palm 28 lie finger knuckles. Little finger knuckle 41 and ring finger knuckle 17 in combination with little finger 40 and ring finger 16 are referred to as the lower fingers. There is a transverse crease 10 within the user's hand 12. The transverse crease 10 runs from the base of the index knuckle 56 to the base of the little finger knuckle 41, the portion in the area of little finger knuckle 41 known as the lower transverse crease 11. Bordering the inside and upper mid palm area 28 are the thumb base 30 and a lower web 32. The thumb base 30 is the muscular portion of the thumb below the thumb knuckle 34 and must be distinguished from the upper thumb base 31. The thumb base 30 is bordered by the lifeline 36. Bordering the lower area of mid-palm area 28 is the tough ball 38 which is the fleshy area adjacent little finger knuckle 41. Further away from little finger tendon 26 is lower tough ball 39, which is still more tough than tough ball 38 (a better stress (reception area) and the area of primary anchor contact for fifth, sixth and seventh embodiments 203, 300 and 400. From tough ball areas 38 and 39 the hand extends inwardly to the fleshy heel 42 which is adjacent the lower section of the lifeline 36. Lying outwardly (forward) and upwardly from fleshy heel 42 is a bony heel 43 (hamate bone) which is an exceedingly sensitive area and an obstacle to the creating of the hand accessory of the present invention since this bony heel 43 is in an area of the hand that moves a large distance during the squeezing action on an implement handle 48. Directly upward of and adjacent the bony heel is a bony lifeline (the metacarpal area). The web must be further defined than in previous patents as containing an upper web 46 between the thumb 44 and the index finger 20, and a lower web 32 extending downward to a point adjacent the thumb base 30 and the upper section of lifeline 36. (It has been determined that material of any significant thickness in the upper web 46 must press from the back side of the hand. Material pressing into upper web 46 from the front side of the hand does not allow the implement handle 48 to contact certain areas of the hand accessory which transmit energy through the lower, stronger areas of the hand. Filling the upper web 46, which was accomplished in the aforementioned patents, could be likened to choking up on the bat—it may provide a quicker swing, but with less power. It protects thumb bones from bruising, but adds stress to the hand.) When the hand 12 moves into phase two grip around the handle 48, the lower web 32 has moved lower to a position adjacent the mid palm area 28 thereby becoming a power area especially in hand accessory 400 which restricts (or inhibits) full phase three hand movement, providing more space for anchoring at lower web 32. Located at the most inward area of the lifeline at the wrist is a wrist hollow 75, another tough, stress reception area.

The following description of hand accessory 51 is primarily for background information, contrasting earlier problems with partial solutions to the current more complete solutions found in hand accessory 400 so as to provide more reasoning behind the utility of the various structures in hand accessory 400.

Figure 3:
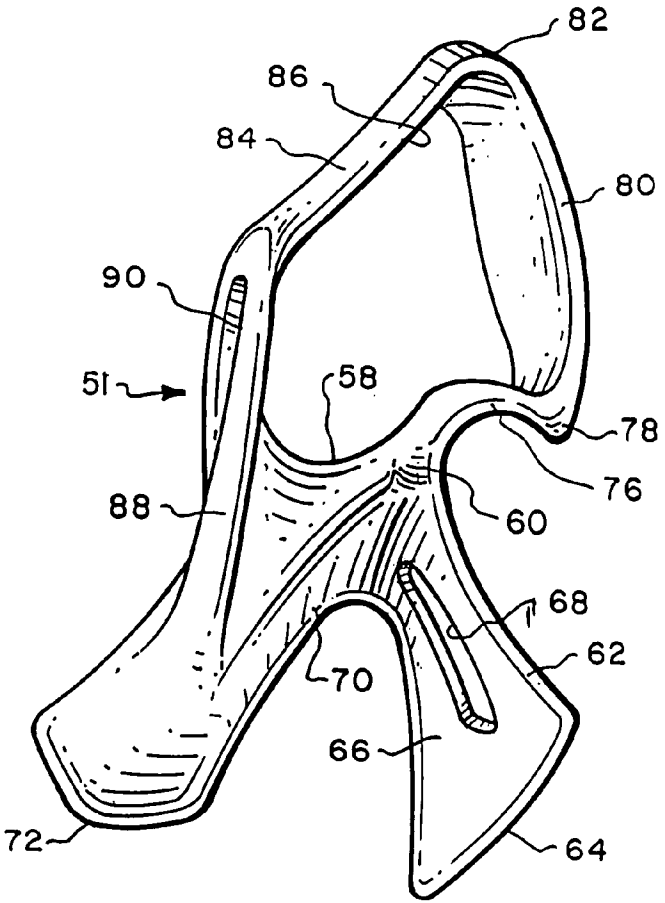
FIG. 3 is a rear elevational view of the first embodiment of hand accessory of the present invention.
Figure 2:
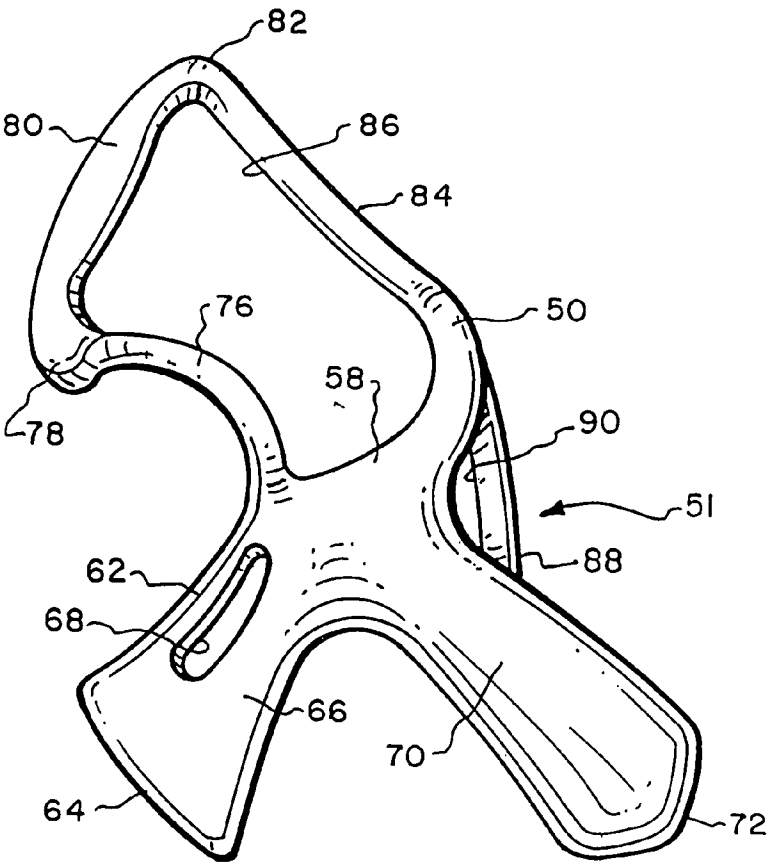
FIG. 2 is a front elevational view of the first embodiment of hand accessory of the present invention.
Figure 4:
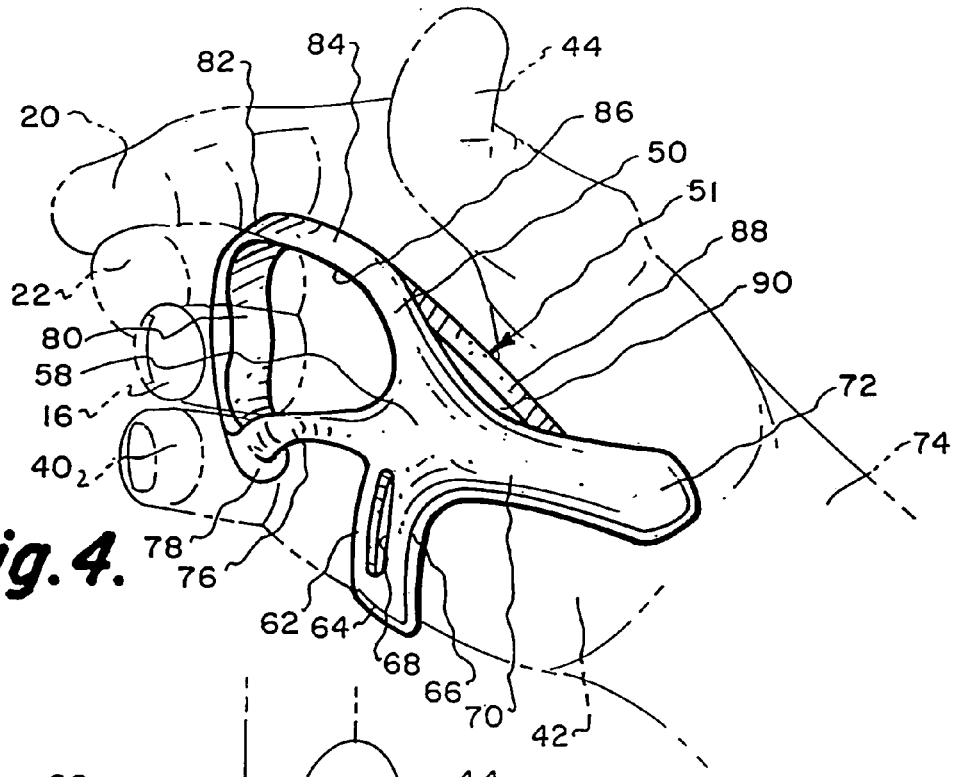
FIG. 4 is a front isometric view of the first embodiment of hand accessory of the present invention showing such mounted in an open hand.
Figure 5:
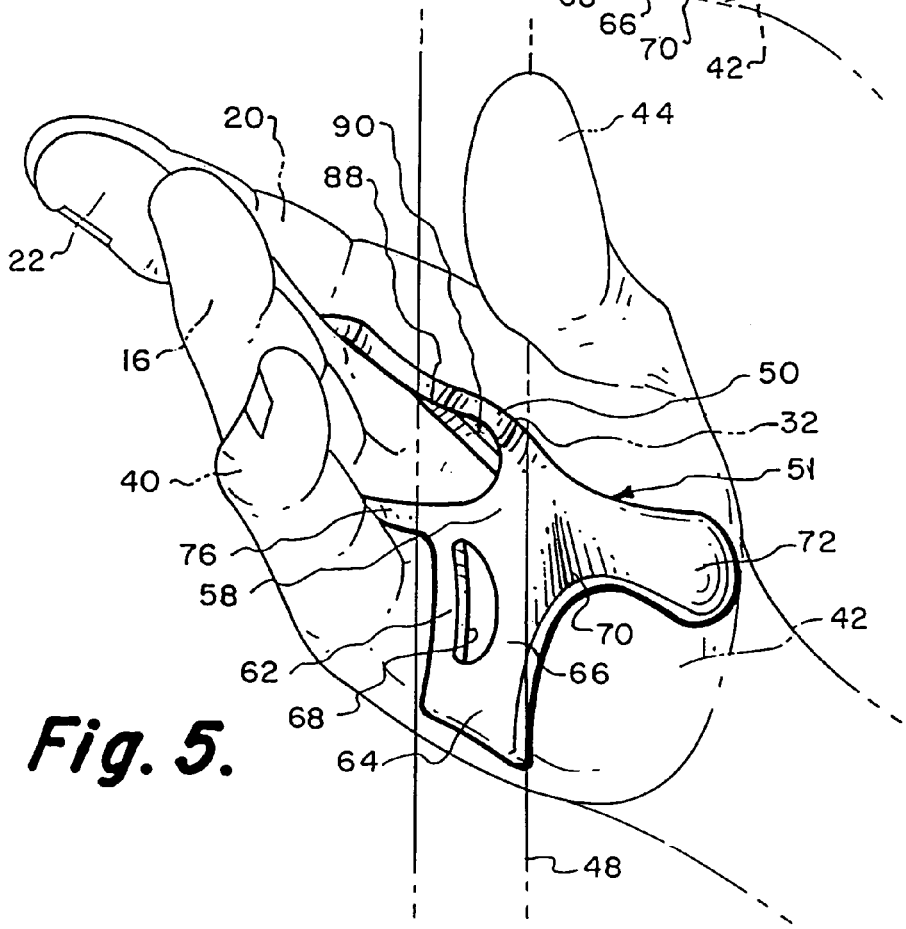
FIG. 5 is a front isometric view of the first embodiment of hand accessory of the present invention showing the first hand accessory being mounted with a human hand and depicting connection with an implement handle.

First embodiment 51 of hand accessory: FIGS. 2, 4 & 5 show the exterior surface of the first embodiment 51, parts of which would be in contact with the handle 48. FIG. 3 shows the interior surface of first embodiment 51, parts of which would be in contact with the hand 12. First embodiment 51 bridges over sensitive bony heel 43 and tendons 24, 26 and 54, and branches out in four directions to anchor in tough areas. As the hand squeezes, the bridge 58 applies force against the implement handle 48. The bridge 58 extends upwardly to connect with the flex connector 50. Because the size of the lower web 32 diminishes during the squeezing action, the flex connector 50 of first embodiment 51 (FIGS. 2-5) which contacts the lower web 32 must be small, precise and flexible. The flex connector 50 joins three other areas all which absorb stress in bridging the sensitive mid-palm area 28. The bridge 58 extends outwardly to ring finger trough anchor 60. The bridge 58 extends downwardly along the lower transverse crease anchor 62 to tough ball anchor 64. From the tough ball anchor 64, the first embodiment 51 includes a tough ball anchor extension 66 which reconnects the bridge 58. Separating the tough ball extension 66 and the lower transverse crease anchor 62 is an opening 68. The bridge 58 extends inwardly becoming wedge 70 extending to a thumb/base heel anchor 72 which is positioned directly adjacent the wrist 74 in the lower portion of lifeline 36 which connects to the hand 12. Extending from the ring finger trough anchor 60 is a suspension 76 which is positioned directly adjacent the wrist 74 in the lower portion of lifeline 36 which connects to the hand 12. Extending from the ring finger trough anchor 60 is a suspension 76 which terminates in a nub 78. The nub 78 is to rest between the little finger 40 and the ring finger 16 on the back side of the hand. Extending from the nub 78 is a finger anchor 80 which terminates in a nub 82. The nub 82 is designed to be located between the index finger 20 and middle finger 22 on the back side of the hand. Connecting nub 82 to the flex connector 50 is a suspension 84. The suspension 84, the flex connector 50, the bridge 58, the suspension 76 and finger anchor 80 all enclose a mounting opening 86, through which the user's middle finger 22 and ring finger 16 are to be inserted. Connecting the flex connector 50 to the wedge 70 is a lifeline anchor/strut 88. The lifeline anchor/strut 88 in connection with wedge 70 and flex connector 50 enclose an opening 90. During the previously described phase two grip the suspension 84 and the lifeline anchor strut 88 move lower as one unit maintaining its position in the lifeline, as the thumb base moves lower during the squeeze. The flex connector 50 then moves upwardly and inwardly anchoring momentarily at lower web 32 under the recoiling implement handle 48.

Within the prior U.S. Pat. No. 5,588,651, the wedge 70 and the lifeline anchor strut 88 were one unit (FIG. 4, area 92). It was discovered that this caused the inside of the hand 12 to slide upwardly along the lifeline 36 during phase three grip which reduced power and added stress to the hand 12 and wrist 74, as the thumb base 30 was not able to move to its lower, more normal position. Putting it another way, the objective is to achieve what would be like the human hand 12 recreated with the thumb base 30 located further outward and downward around the area of the bony heel 43 creating a lifeline that would lie more parallel to the transverse crease 10 thus holding the implement handle 48 in the best position for power with the pivot point closer to the end of the handle 48. Lifeline anchor/strut 88 allows for an anchoring area aiding in holding bridge 58 above the sensitive mid palm area of the hand 12 while its flexibility allows the thumb 44 more movement than prior hand accessories holding the leverage power of wedge 70 in a straight line between the thumb/base/heel anchor 72 and the ring finger trough anchor 60. Lifeline anchor/strut 88 is like a brace keeping wedge 70 from collapsing as the downward force of the expanding muscle of lower thumb base 30 acting against wedge 70 is harnessed toward the handle 48. Also, lifeline anchor/strut 88, in conjunction with thumb base/heel anchor 72 and tough ball anchor 64 and tough ball anchor extension 66 position wedge 70 away from the sensitive bony heel 43.

Also, in prior U.S. Pat. Nos. 5,180,165 and 5,588,651, the lower transverse crease anchor 62 and tough ball anchors 64 and 66 were one unit. (The attempt to derive additional bat handle support from the material in the tough ball area 38 has been a challenging dilemma which was not solved until the latest sixth embodiment of hand accessory 300 (described later), however, now described first embodiment 51 was a step in the right direction so its description is included. During the squeeze the trigger action of the little finger tendon moving inwardly combined with the outward movement of the tough ball area reduces the space available for the material of the hand accessory. This results in blocking the full squeezing movement of the hand 12 and causes stress on the little finger tendon 26 just below the knuckle. Separation of the two areas by the inclusion of the opening 68 was one solution to this problem.

Figure 6:
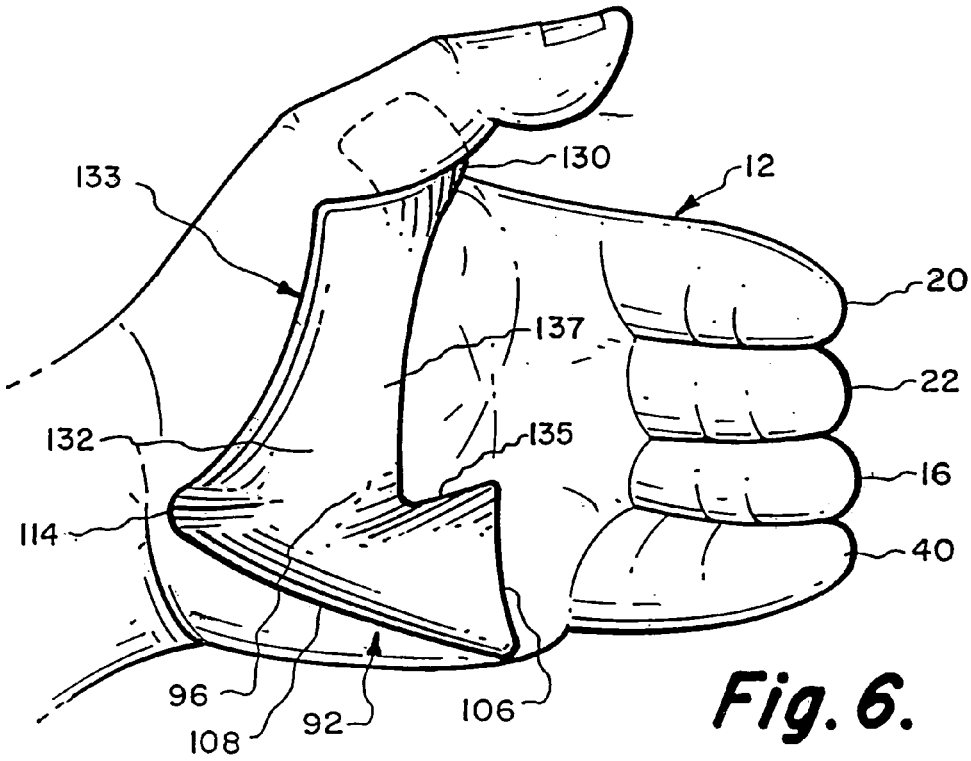
FIG. 6 is a front isometric view of a second embodiment of hand accessory of the present invention showing the second embodiment of the hand accessory being mounted within an open human hand.
Figure 7:
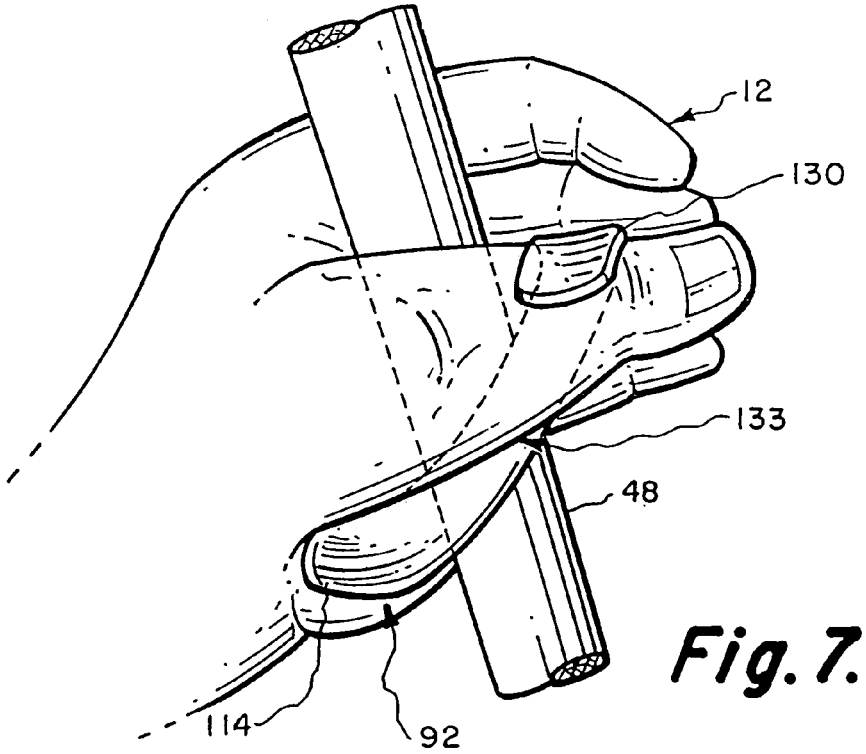
FIG. 7 is a view similar to FIG. 6 showing the second embodiment of hand accessory of the present invention in a closed hand.
Figure 8:
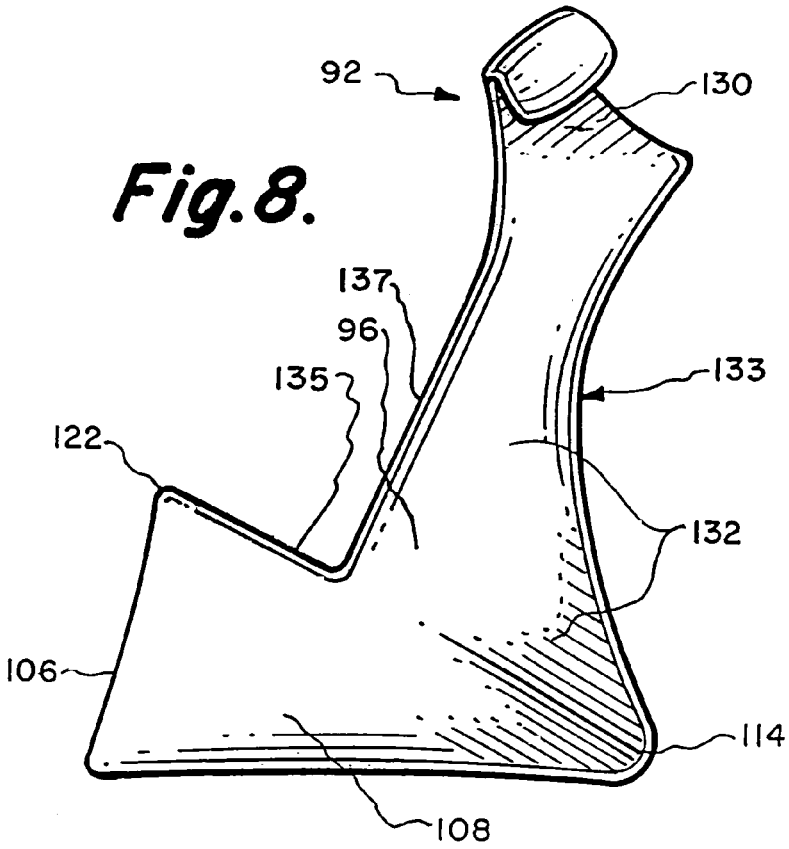
FIG. 8 is a rear elevational view of the second embodiment of hand accessory of the present invention.
Figure 9:
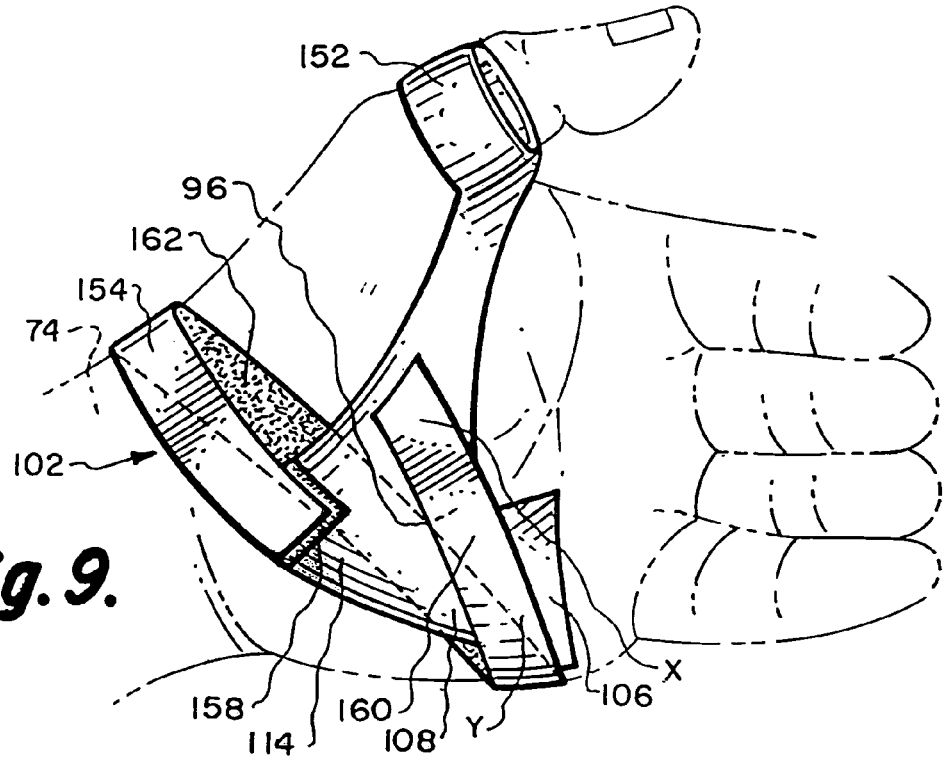
FIG. 9 is a front isometric view of a third embodiment of hand accessory of the present invention showing such mounted on an open hand.

Second embodiment 92 of hand accessory: (At this time it was still thought by inventor that different structure was needed for top and bottom hands.) Second embodiment 92 of hand accessory was designed for the bottom hand, incorporating some of the discoveries of hand accessory 51. As in hand accessory 51, hand accessory 92, see FIGS. 6, 7 and 8, has a convex exterior surface and a mostly concave interior surface, in fact, the whole body could be thought of as a bridge crossing over the sensitive mid palm 28. As in first embodiment 51, bridge 96 is also supported by a thickened thumb base/heel anchor 114, but is not constructed to arc out so far, however, it does move out considerably due to leveraging from the thumb/wrist function (bottom hand phase two described previously). The bridge 96 connects to a lower transverse crease anchor 106 and tough ball anchor 108. Bridge 96 connects inwardly to thickened thumb base/heel anchor 114 which rests only in the lower portion of lifeline 36, not extending as a wedge to the ring finger trough 18 as in first embodiment 51. Thumb base/heel anchor 114 extends upwardly to thumb base anchor 132 and thumb joint anchor 130, the whole area being called the thumb lever 133 which moves as one unit during the thumb/wrist function with the inside portion of the hand 12 and upper wrist 74 moving downward and extending outward relative to the fingers. Thumb base/heel anchor 114 aligns with the ring finger trough anchor 122, but the area between the two is thinned and concave on the interior side, both areas serving to hold the arced bridge 96 away from the sensitive mid palm area 28 and bony heel 43 of the hand 12, and also serving as a pivoting area for the downward motion of the thumb/wrist function. Thus, the thumb lever 133 with such moving sideways to the handle and partially wrapping around the handle 48 with a shearing force providing greater transmission of power in the swinging motion. (This motion better illustrated in FIGS. 10, 11 and 12.)

The third embodiment 102 of hand accessory provides a circular attachment 152 for the thumb and a strapping arrangement 154 and 160 (probably elastic) such that third embodiment 102 may be secured to the hand allowing any make of glove to be pulled over the hand rather than having third embodiment 102 attached to the inside surface of a glove (as is the intention in the other embodiments). The strapping arrangement comprises wrist strap 154 to be located about the wrist 74 of the user. Strap 154 is secured by releasable securement pad 158 to the exterior side of thumb base/heel anchor 114, then encircling the back side of the hand and wrist extending to the front side at the exterior area of bridge 96 where it is permanently secured, there called palm strap 160. The palm strap 160 is integral with the wrist strap 154. Except for the addition of the straps 154 and 160 and the circular attachment 152, the third embodiment 102 is essentially identical to embodiment 92.

It was found that the straps 154 and 160 increase the performance of third embodiment 102, probably for two reasons: Pressure on the hand's tough ball 38 and heel 42 tends to "pop out" bridge 96 increasing resistance against the handle 48, and the stretching between points x and y increases the tension between bridge 96, and tough ball anchor 108 and lower transverse crease anchor 106, (like stings of a tennis racket) increasing the force transmitted to the handle and further protecting the bony heel 43 and finger tendons 24, 26, 54 and 56. It should be noted that third embodiment 102 could have a double strapping arrangement and be built into a glove, with the separated intermediate portion 162 of the straps 154 and 160 extending to and being attachable to the outside surface (not shown) of the glove.

Figure 10:
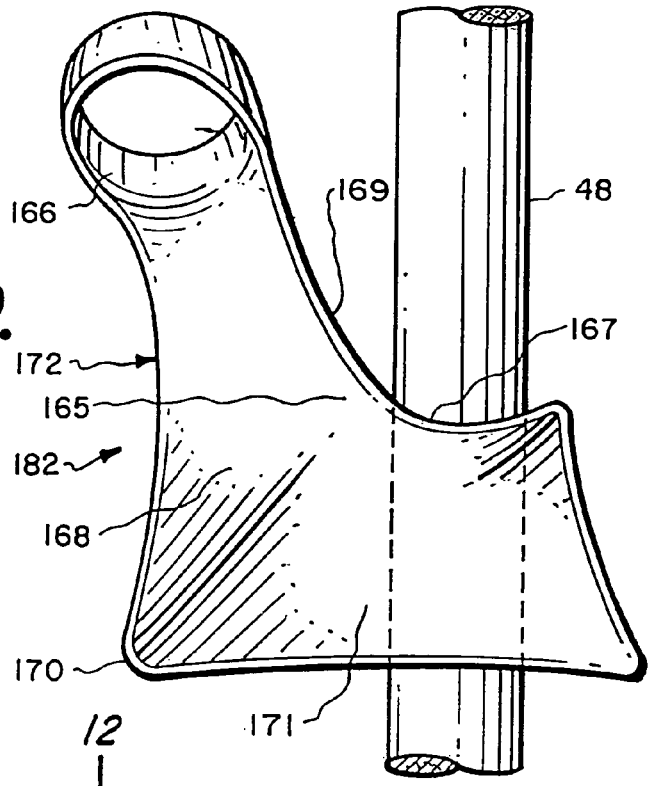
FIG. 10 is a rear isometric of a fourth embodiment of hand accessory of the present invention showing the fourth embodiment of hand accessory as it begins to connect with an implement handle.
Figure 11:
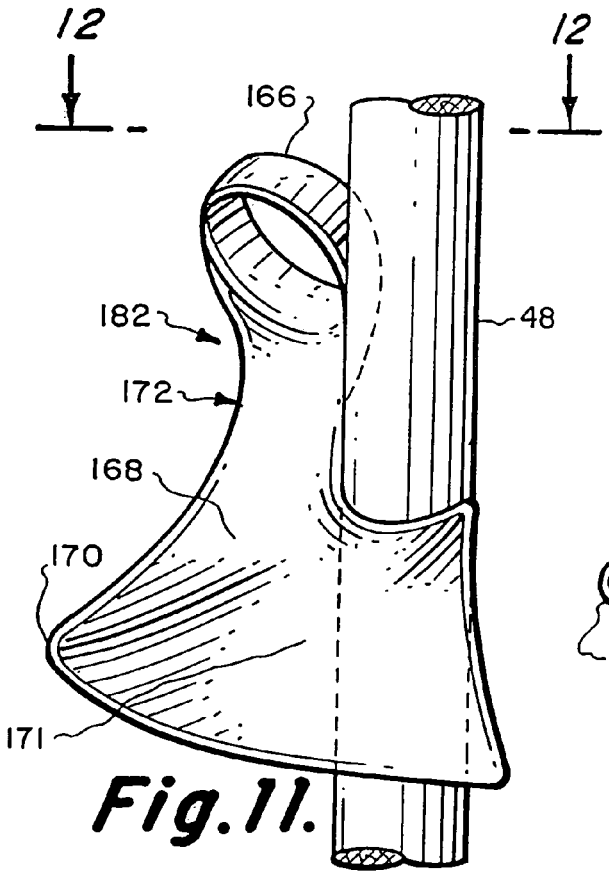
FIG. 11 is a view similar to FIG. 10 except the fourth embodiment of hand accessory is being moved in greater contact with the implement handle.
Figure 12:
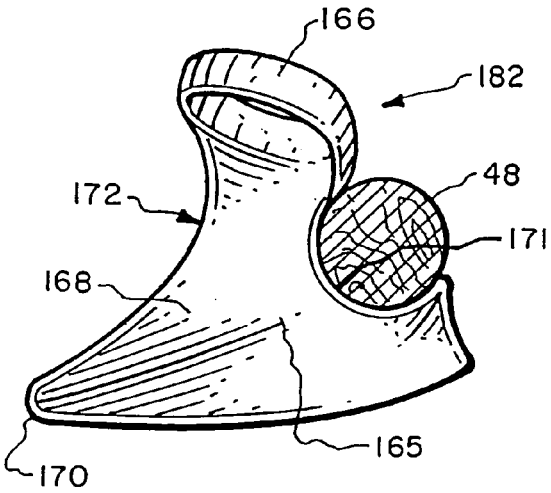
FIG. 12 is a top plan view, with the implement handle in cross-section, of the fourth embodiment of hand accessory of the present invention taken along line 12-12 of FIG. 11 as it would be with a hand at its fullest grip.
Figure 13:
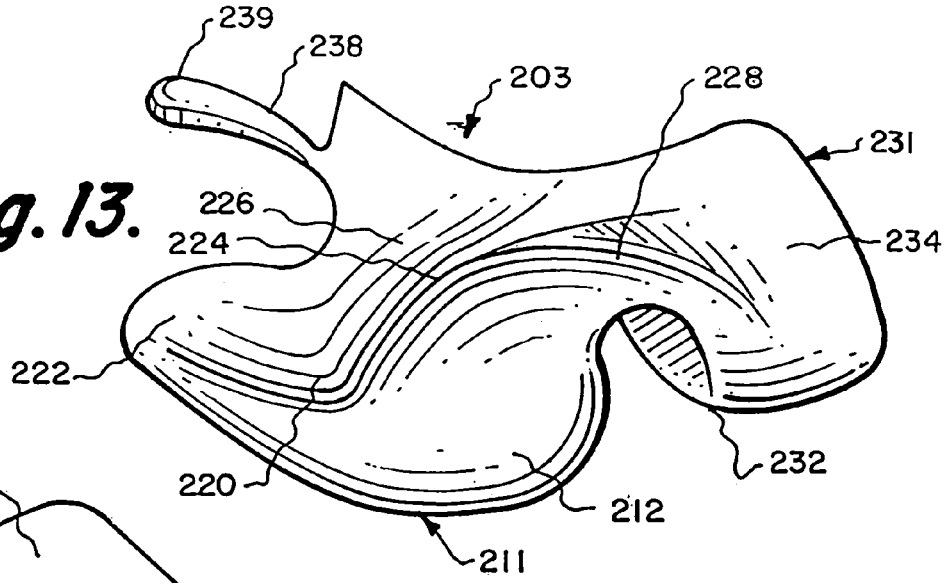
FIG. 13 is a front elevational view of a fifth embodiment of hand accessory of the present invention.

Fourth embodiment 182 is an attempt to create a top hand version of second embodiment 92 that is basically the same as the bottom hand embodiments 92 and 102 with there being differences in thickness, angles and dimensions (see FIGS. 10, 11 and 12). The following refers to the right (top) hand because it has been the main focus of the previous patents. Thus, for point of comparison and to tie together current with prior inventions, hand accessory 182 stems basically from U.S. Pat. No. 5,180,165, which was the filling of the triangular shaped palm depicted in embodiment 44, FIG. 10 (right triangle plug) of patent '165 and further, embodiment 78 depicting the harnessing of power from the thumb base connected to the right triangular shaped plug (FIG. 14) of patent '165. Thus, the concept was to allow power to flow directly from the arm and wrist through the lower portions of the hand (mid palm area 28), keeping the handle out in a finger grip and preventing stress from being received in the upper area 34 and 46 of the hand 12 from bat recoil (or any other force such as heavy bar bells). Thus, if we use outer end 68 with a small portion of base 74, eliminating the inside material (which would press against the sensitive tendons) by cutting diagonally upward to a point at top edge 70 adjacent outer end 68 (in the form of a triangle), we could then extend upward from the point at top edge 70 to our latest thumb lever 172 and extend inward from 68 to our latest thumb base anchor 168 and thickened thumb base/heel anchor 170, similar to area 84 of FIG. 14 of patent '165. In fact, the embodiment shown in FIG. 14 of patent '165 would be still more similar if area 84 arced over area 82 (instead of area 82 being concave) and if a tough ball anchor were attached at the base.

Thus, the fourth embodiment 182 (similar to the second and third embodiments, incorporates structure from first embodiment 51 such as bridge 165, tough ball anchor 171, and thumb base/heel anchor 170 (shown only internally, FIGS. 10-12), while eliminating the lifeline anchor strut 88, flex connector 50, suspension 84 (FIG. 3) and replacing such with a long thumb lever 172 which extends from thickened thumb base/heel anchor 170 to above the thumb knuckle joint 34 of hand 12 (not shown) ending at thumb anchor 166. (Thumb anchor 166 and the upper portion of thumb lever 172 were later found to be unnecessary.) Hand accessory 182 is thick only from the "base of the triangle" (patent '165, FIG. 10) and extending to the thumb base/heel anchor 170. All other areas are quite thin, but due to their configuration absorb stress all along the tough portions of the hand's tough ball 38, fleshy heel 42 and thumb base 30. Depicted in FIGS. 10, 11 and 12 is an imaginary hand moving from phase one (FIG. 10) through phase three (FIG. 12) whereby the area of the bridge outside edge 167 and thumb lever outside edge 169 known as the lever-edge 171 exerts a shearing force against handle 48.

Fifth embodiment 203 of hand accessory (FIGS. 13-19) consists of a tough ball anchor 211 and a thumb anchor 231, each of which work somewhat independently in supporting a bridge 226 which arcs over sensitive areas (description following) of hand 12.

A primary contact point 222, which is the initial direct contact and stress point between the bat handle 48 and the fifth embodiment 203 occurs in an area of the hand 12 which is lower and more outwardly (toward the fingers) than in all previous embodiments. The many benefits derived from this to be explained after first describing how this lower contact area is accomplished, starting with a tough ball anchor 211 which is much larger in area (and partially in thickness) than previous anchors in that general area.

Tough ball anchor 211 contacts the hand 12 as far inwardly as the lower portion of fleshy heel 42, extending outwardly and downwardly past the lowest portion of hand 12 (wrapping around the lower tough ball 39) to the area of the little finger bone on the back side of the hand (not shown in drawings), and continuing outwardly to the area past the little finger knuckle 41 on the back side of the hand which would be in the area of nub 78 of first embodiment 51 (FIG. 3). It arcs over (does not press against) much of the original tough ball area 38 adjacent the little finger tendon 26 (inside of hand).

Areas within tough ball anchor 211 are fulcrum 216 (seen internally), primary contact point 222 (the external side of fulcrum 216), tough ball wedge 220 (seen externally) and fleshy heel phase two lever 212. Partially within and connecting to tough ball anchor 211 are bridge 226 and lever 224 (seen externally just above tough ball wedge 220). It should be noted that a portion of tough ball anchor 211 is a bridge, most of lever 224 is a bridge, and a portion of thumb anchor 231 (described later) is a bridge, as all these areas connect in a certain gradation of thickness so as to disperse energy in the proper degree to the proper areas, however for descriptive purposes such shall be differentiated.)

Tough ball anchor 211 extends upwardly to the arcing bridge area which consists of a thinner portion, bridge 226 and a thicker portion, lever 224. Tough ball anchor 211 when combined with lever 224 becomes a tough ball wedge 220, the closest power area to fulcrum 216, which is a pivot area internally of primary contact point 222, the first area of fifth embodiment 203 to receive stress followed immediately by wedge 220 transmitting power during the phase two stage of the grip. The hand's fleshy heel 43 area of tough ball anchor 211 in combination with tough ball wedge 220 becomes a fleshy heel phase two lever 212. Lever 224, where combined further upward and inward with lifeline anchor 236 (seen only internally) becomes bridge/lifeline phase three lever 228.

Not only does the greatly enlarged tough ball anchor 211 reduce upward movement of fifth embodiment 203 as phase two grip occurs, but also harnesses the forward/downward movement of lower tough ball 39 of hand 12 to force (wedge) the handle 48 further out in the fingers and allows room for the tough ball 38 little finger tendon 26 area of hand 12 to move forward during its phase two and phase three grip, the hand 12 pivoting not so much along the transverse crease lines 10 and 11 (as it does when the handle falls out of the finger grip into the inner area of knuckles and mid palm 28), but along the area above (outwardly of) the lower knuckles 41 and 17. And, just as the longer a lever is from its fulcrum the greater the power, the further out the handle 48 is located, the greater the leverage gained from the movement of the more distant inner perimeter areas of the hand, transmitted through phase two lever 212 to tough ball wedge 220 and phase three lever 228 to contact lever 224 to bridge 226. The much large tough ball anchor 211 also makes possible the following:

In previous embodiments, a "fulcrum", or pivot point, was located in the deep area of ring finger trough 18. In fifth embodiment 203, the fulcrum 216 is actually located partially below the hand 12 in the area of lower tough ball 39, outside of the lowest portion of lower transverse crease 11, almost to the backside of hand 12 resting adjacent little finger knuckle 41 as a mostly flat, concave surface. Helping stabilize fulcrum 216 is bank 13 of hand 12, the "meaty" portion of tough ball 38 and 39 which raises up above the little finger knuckle area 41 when the hand squeezes, creating a bank 13 which one may notice by pressing one's finger inward against the lower portion of lower transverse crease 11 (while hand is gripping to close). A ridge 214 in fulcrum 216 rests against bank 13 of hand 12, further enhancing stabilization of fulcrum 216. Due to thickness at primary contact 222 and the angle and alignment with fulcrum 216 and tough ball wedge 220, as the hand 12 moves into phase two grip, primary contact point 222 next to little finger knuckle 41 is forced slightly backward by the handle 48 causing a pivoting of fifth embodiment 203 atthe fulcrum 216 and bringing tough ball wedge 220 into contact with the handle, leveraging the handle 48 further toward the fingers than it would appear able to in the phase one and two grips. Except for ridge 214, fulcrum 216 is not easily distinguished visibly, rather, its presence being felt as the primary pivoting point, as all levers lead to and pivot at fulcrum 216, beginning with fleshy heel phase two lever 212, and then in concert thumb base/wedge 234, bridge/lifeline phase three lever 228 and lever 224. It is primarily this location of fulcrum 216 that allows the hand 12 to pivot (in closing) outward of the knuckles (lower knuckles 41 and 17 being the greatest challenge), and allows the handle 48 to remain outward in the lower fingers 40 and 16, creating greater leverage.

How can there be more room for the hand's forward movement as stated above? Because lever 224 arcs over and past much of the previous tough ball anchoring areas (in the inventor's earlier patents) to the lower tough ball 39 area of hand 12 creating space on the interior side of fifth embodiment 203 for the forward movement of the area of the hand's tough ball 38 and little finger tendon 26. (Note the previously described first embodiment 51 had the problem of the little and ring fingers moving inwardly while the tough ball moved outwardly (toward each other), reducing space therein for previous embodiments? That problem is now reduced because 1) there is little to no material pressing in that area (little finger tendon 26 and tough ball 38) and 2) there is now less reduction to begin with in space available for fifth embodiment 203 because the hand 12 is now pivoting relatively more outward of its lower knuckles 17 and 41 than inward (not down in the transverse crease area) since the bat is being held further out in the fingers (the hand not buckling). This also improves the phase three grip at impact keeping the lower portion of hand 12 straighter behind the handle (like a battering ram) rather than buckled.

Figure 19:
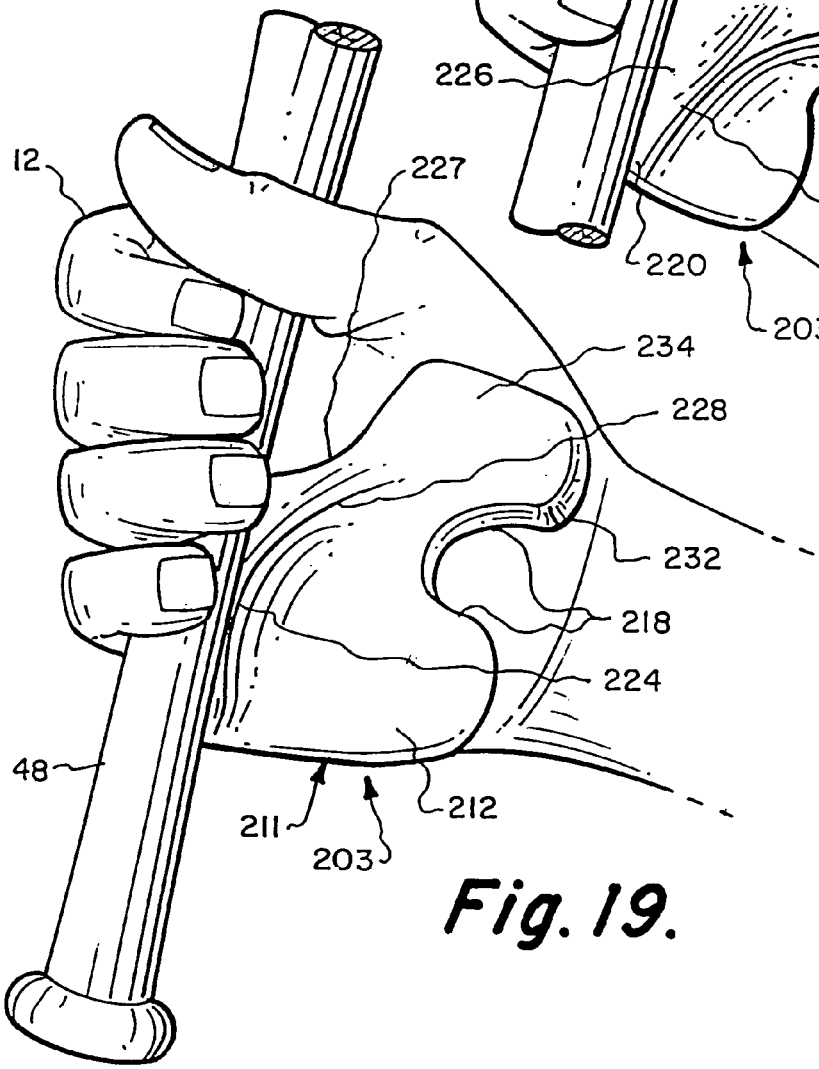
FIG. 19 is a view similar to FIG. 18 where the human hand is applying a phase three grip.
Figure 20:
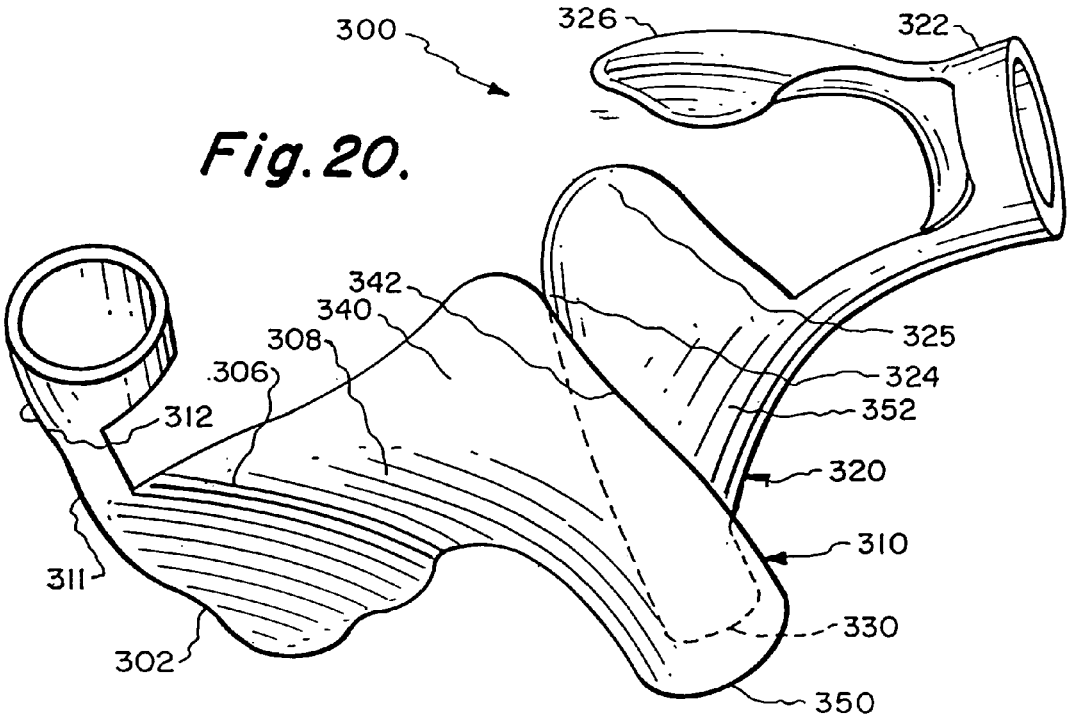
FIG. 20 is a front elevational view of a sixth embodiment of hand accessory of this invention.

As seen exteriorly (FIG. 13), phase three bridge/lifeline lever 228 extends upward and inward to thumb base/wrist anchor 232 (although its upward angle is more forward during the phase three stage of the grip as seen in FIG. 19). (The function of the thumb base/wrist anchor 232 is almost identical to the thumb base/heel anchors of the bottom hand accessories 92-192, but called thumb base/wrist anchor because fifth embodiment 203 has a separation 218 such that the anchoring area in the lower lifeline 36/thumb base 30 of hand 12 does not contact the hand's heel 42 and 43 area, rather, extends further inward to the wrist 74.)

Fleshy heel phase two lever 212 and the rest of tough ball anchor 211, in conjunction with lever 224 and lifeline anchor 236, support bridge 226 which extends outwardly from lever 224 and the bridge/lifeline phase three lever 228 becoming very thin in the area of little finger knuckle 41 and the ring finger knuckle 17. As seen interiorly (FIGS. 14 and 15), bridge 226 extends upwardly and inwardly to thickened lifeline anchor 236. Lifeline anchor 236 (seen only interiorly) extends inwardly to thumb base/wrist anchor 232 as does phase three lever 228, however, the two structures do not exactly align interiorly and exteriorly and do not travel in quite the same direction during the squeeze, the phase three lever 228 extending from the thumb base/wrist anchor 232 outwardly and downwardly (as seen exteriorly), the lifeline anchor 236 extending outwardly and upwardly (as seen interiorly). The lifeline anchor 236 aligns with the hand's lifeline 36 and ends outwardly/upwardly at the hand's lower web 32, however it does not rest in those areas and only presses slightly during phase three of the grip (during greatest stress in the upper areas), the greater pressure being felt in the area of hand 12 where lifeline anchor 236 joins thumb base/wrist anchor 232.

Seen internally, lifeline anchor 236 thins upwardly and inwardly to thinned thumb/wedge 234, which rests and is a pivot area against the hand's upper thumb base 31. Thumb base/wedge 234 does not restrict (does not attempt to harness) forward motion of the thumb during the squeeze as it did in some earlier embodiments, rather, thumb base/wedge 234 allows transmission of force from the expanding muscles in thumb bases 30 and 31 to the lifeline anchor 236, phase three lever 228, lever 224 and bridge 226, (in conjunction with thumb base/wrist anchor 232), forcing such away from the sensitive areas of mid palm 28. As seen externally, the upper portion of thumb base/wedge 234 extends lower and outward, thickening to bridge/lifeline phase three lever 228 and then contact 224. Extending further outward is the thinned area of previously described bridge 226. At an outer portion of bridge 226, located between little finger 40 and ring finger 16, a ring finger trough extension 238 extends to a finger anchor 239 on the back side of hand 12, for further support of bridge 226.

The combined area of structurally joined thumb base/wedge 234, lifeline anchor 236 and thumb base/wrist anchor 232, to be called thumb contact 231, operates somewhat independently of tough ball anchor 211. Seen better internally, a separation 218 below lifeline anchor 236 at the hand's bony heel 43 portion of tough ball anchor 211 allows for a certain independent movement of thumb contact 231. While stress is received in the thumb base/wrist anchor 232 portion of thumb contact 231 during the phase two grip (see FIG. 18), as the hand 12 moves into the phase three grip (See FIG. 19) there is a spreading of the hand 12 between the areas of tough ball 38 and thumb base 30/31 (note the larger space at separation 218 in FIG. 19). There is a recessed area (seen internally) inward of separation 218 extending from the exterior side of lifeline anchor 236 (the area of bridge/lifeline lever 228), recess 219 being thin structure extending downwardly to fleshy heel lever 212 and outwardly to the lower portion of bridge 226, recess 219 aiding separation 218 in the phase three movement. Recess 219, in combination with separation 218, fleshy heel lever 212, thumb base/wrist anchor 232 and lifeline anchor 236 helpful in providing avoidance of the hand's sensitive bony heel 43, one of the main obstacles in past embodiments.

Another factor in the improved bridging of the sensitive tendons in mid palm 28 is the angle of thumb contact 231. Rather than the lifeline anchor 236 portion arcing concavely to fit flush in lifeline 36, it is convex to lifeline 36 (See FIG. 16) flaring out such that the upper area of thumb base/wrist anchor 232 (the innermost portion of fifth embodiment 203) is an inch or more distant from hand 12 (without glove pressure). Thumb base/wrist anchor 232 also extends slightly past the hand's thumb bases 30 and 31 to anchor partially in the wrist 74 such that when glove pressure is applied at point A (FIG. 17) a pivot area 233 of thumb contact 231 pivots at the mid portions of lifeline 36 and upper thumb base 31, so that as the thumb base/wrist anchor 232 is pressed toward hand 12 by glove pressure, the other (outside) end connected to the upper area of bridge 226 pivots away from the hand, see arrow B.

Figure 18:
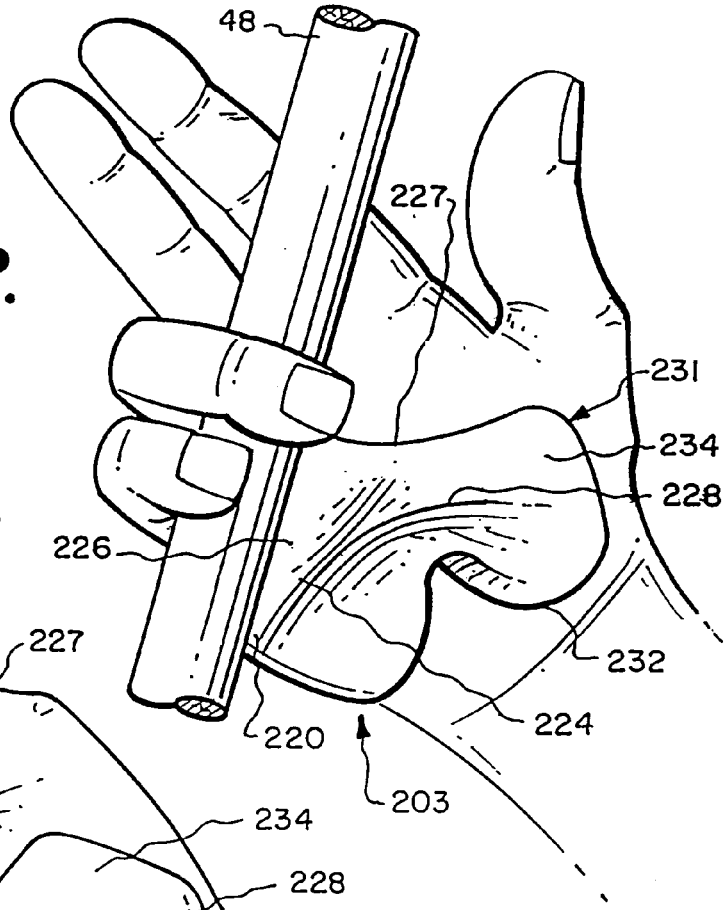
FIG. 18 is a view showing the fifth embodiment of hand accessory in conjunction with a human hand where the human hand is applying a phase two grip.

A combination of the above factors, including pivot area 233 and separation 218 cause upper bridge area 227 to arc outward, away from sensitive mid palm 28 (see FIG. 19 contrasted to FIG. 18).

Sixth embodiment 300 (FIGS. 20-26) of hand accessory consists of two nearly separate structures, a tough ball anchor 310 (with circular little finger attachment 312) and a lifeline anchor 320 (with circular thumb attachment 322), attached in only one area, swivel 330, allowing more successful thumb participation than previous embodiments.

Figure 14:
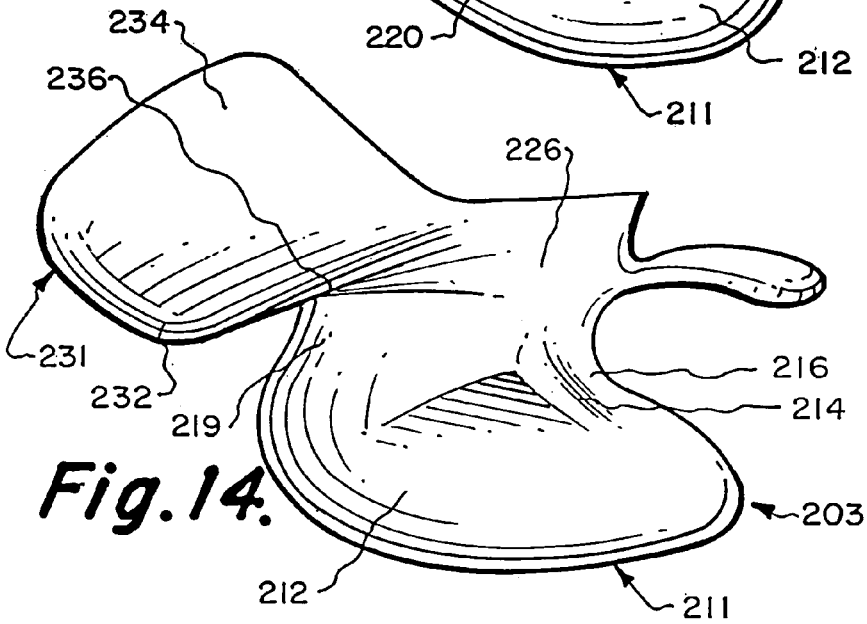
FIG. 14 is a rear elevational view of the fifth embodiment of hand accessory of the present invention.
Figure 15:
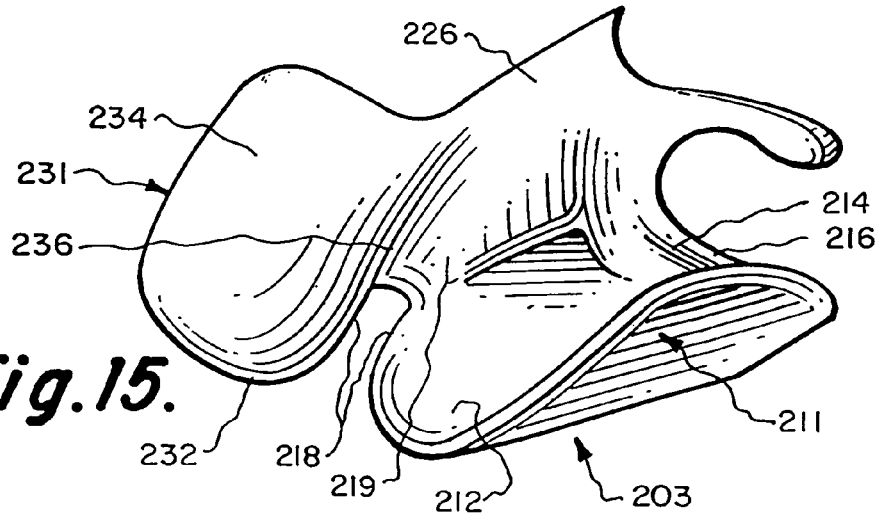
FIG. 15 is a rear elevational view of the fifth embodiment of hand accessory of the present invention taken at a slightly different angle.
Figure 16:
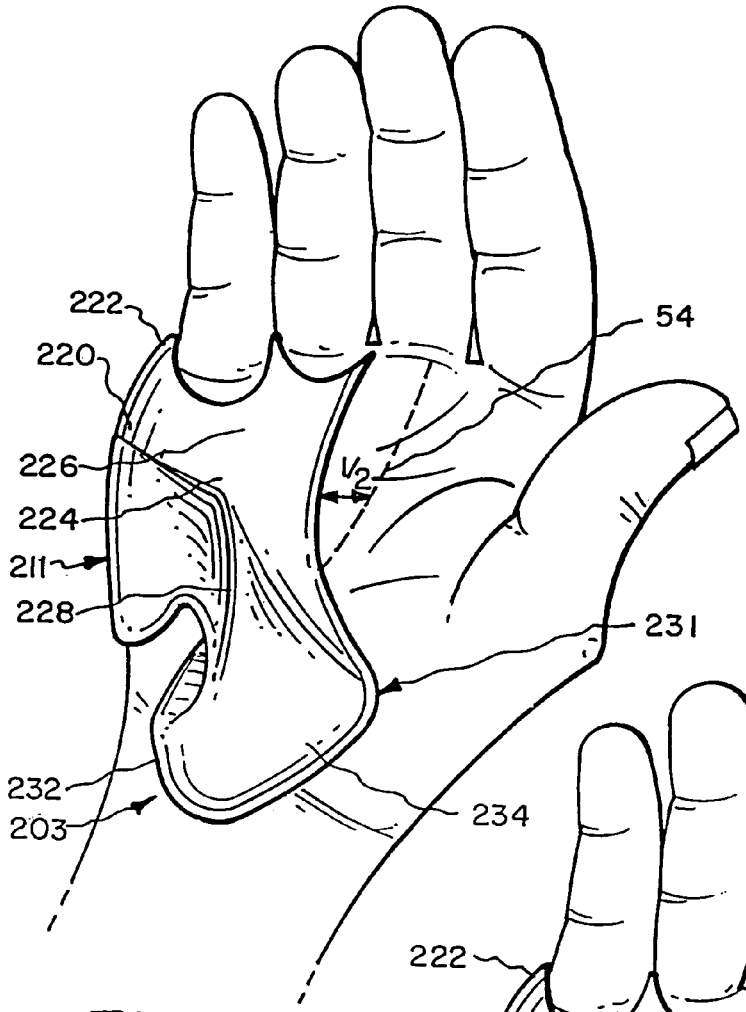
FIG. 16 is a front view of the fifth embodiment of hand accessory of the present invention showing such mounted in conjunction with a human hand and showing the fifth embodiment of hand accessory in the position it would be with no pressure being applied by an external glove.
Figure 17:
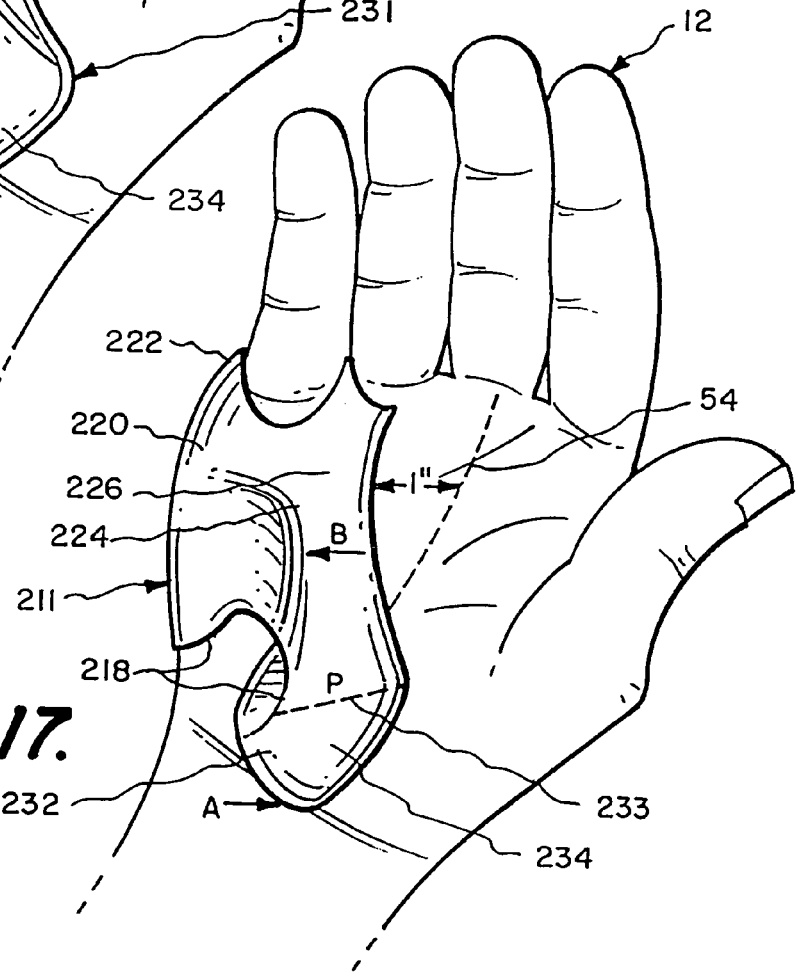
FIG. 17 is a view similar to FIG. 16 with pressure being applied to the hand accessory by an external (imaginary) glove.

The current tough ball anchor 310 is similar to and derives from the whole fifth embodiment 203, (see FIG. 14). It is important to note that tough ball anchor 310 when connected to and supported be an external glove is workable without lifeline anchor 320, however the addition of lifeline anchor 320 enhances the strength and stability of tough ball anchor 310, distributing stress over a larger area of the hand providing more complete comfort in all types of gripping of thin handles.

Reiterating hand locations (FIG. 1): moving forward or outward is toward the fingers, inward being toward the wrist, upward being toward the web (upper area or "upper hand" including thumb and web), and downward being toward the tough ball (lower area or "lower hand" including tough ball, fleshy heel and wrist hollow), "lower fingers" being the little and ring fingers including the knuckle joint, and lastly, moving externally would be above (away from) the palm side or front side of the hand. All hand location numbers are two digits. All hand accessory numbers are three digits, however for added clarity hand locations are sometimes preceded by "the hand's _".

Lifeline Anchor areas: Similar in concept to "thumb anchors" of previous embodiments, the term "lifeline anchor" 320 was chosen because of some success over past difficulties in anchoring into a certain tough area of the hand's lifeline/lower web 32 thereby harnessing power from thumb 44 without discomfort to the hand, restriction of thumb movement, or conflict with or distortion of other areas of the hand accessory, while still keeping lifeline anchoring areas fixed in their positions. Extending upwardly from its connection to tough ball anchor 310 at swivel 330 is lifeline contact 324 of lifeline anchor 320. The upper portion of lifeline contact 324 is lifeline/web contact 325 which presses into the hand's lower web 32 a very small area when the hand is in full grip but with a potential for generation of power which the current inventor has tried to tap in most previous inventions. Viewing one's gripping hand one will notice that as the bulky thumb base 30 moves forward, the index knuckle and lower web area move relatively backward (inwardly) causing a lifeline/web connection to be pushed forward out of its anchoring position. The solution was swivel 330 in conjunction with certain other structure producing a certain rotation of hand accessory 300 (explanation following) whereby thumb 44 does not slide past lifeline anchor 320 but is "locked in" by lifeline/web contact 325 held partially by pressure from handle 44 such that the thumb's motion generates power through swivel 330.

Thus, lifeline anchor 320 anchoring in the upper area of the hand harnesses power while remaining in contact with the area of the hand's lifeline 36 and lower web 32 without handle 44 causing upper area hand stress, without discomfort or impingement to the thumb's natural movement which flows downwardly, outwardly (forward) and then upwardly relative to handle 48 (see grip analysis, pages 5-7), stabilizing swivel 330 and channeling force through swivel 330 to tough ball anchor 310 anchored in the lower hand.

Much of the structure of lifeline anchor 320 is thumb base wedge 352, which contours the thumb 44 with thin material extending upwardly from swivel 330 and inwardly from lifeline contact 324, thumb base wedge 352 resting against the hand's thumb bases 30 and 31, and extending upwardly to circular thumb attachment 322, thence extending to the back side of the hand to glove/web anchor 326 pressing into the top of the hand's upper web 46 (from the back side of the hand) and serving to locate and fix the hand accessory to a glove. Glove/web anchor 326 is constructed at such an angle as to create forward tension at thumb attachment 322 away from the hand's sensitive thumb bones 34 when glove/web anchor 326 is flexed slightly forward to its attachment area of a glove. Glove/web anchor 326 also may receive contact from recoiling handle 48 depending on the user's grip, but the great majority of energy is dissipated in the lower hand through structure in the lower areas of embodiment 300.

Previous lifeline anchors often called thumb anchors had larger areas of connection to lower areas of the hand accessory such as the bridge (see previous reference to embodiment 51, FIG. 4) attempting to gain thumb strength in order to, one: thrust bridge 340 externally above sensitive knuckle and mid-palm tendons, and two: exert a holding pressure on the lower, receiving areas of the hand accessory (connected to the bridge) against internal, inward pressure or in the case of a bat handle, internal, upward and then inward pressure, however because the lower fingers move inwardly relative to the thumb moving outwardly and upwardly during the grip, various conflicts were always created. The current bridge/lifeline disconnect 343 (FIG. 23) a space where previous hand accessories were connected, formed by the proper position and angle of lifeline anchor 320 and tough ball anchor 310 joined at swivel 330 combined with improvements in tough ball anchor 310 (explained following) overcome the above problems, allowing embodiment 300 to channel force from a full range of thumb motion to lower tough ball anchor 310 where the greatest stress is received, in other words, the lifeline anchor 320 is allowed to follow thumb movement outwardly and upwardly toward the index finger 20 as tough ball anchor 310, though seen moving outwardly relative to handle 48 during phase two grip actually moves inwardly and downwardly relative to the thumb, especially during phase three grip as the thumb continues forward, the two structures becoming a further distance apart as the hand tightens through phase three. Bridge 340 is now held externally more successfully by the anchoring effect of lifeline anchor 320, channeling force from thumb movement through swivel 330 to tough ball anchor 310. Swivel 330 appears to be located at bony lifeline 27 but does not receive stress at bony lifeline 27 due to a fulcrum effect of thumb base/wrist anchor 350 holding swivel 330 comfortably away from the described sensitive areas (explained later).

[Referring back to embodiment 51 (FIG. 4): If lifeline anchor/strut 88, instead of connecting to flex connector 60 extended to and made contact only with hand 12 at web/thumb area 46 and if all structure above bridge 58 were removed, embodiment 51 would be very similar in concept to current embodiment 300 except for the lower tough ball area.]

Tough ball anchor 310: The main purpose of hand accessory 300 is to reduce stress on the weaker and/or more sensitive upper areas (upper hand) transferring stress to the lower, tough ball and wrist areas (lower hand). The main anchoring area of tough ball anchor 310 is fulcrum platform 302 resting against the hand's lower tough ball 39, its thickest area being a ridge 304 pressing into the hand's lower tough ball 39 (aided by an outer glove) creating a repositioned fleshy ridge 14 of hand 12 which fills a fleshy relocation channel 309 at the interior of tough ball anchor 310. A wider portion of ridge 304 adjacent the hand's heel 42 pressing into the lower tough ball 39 moves the repositioned fleshy ridge 14 more upwardly and exteriorly at tough ball 38 behind (inward of) the resting area of handle 48. Ridge 304 extends outwardly narrowing to a high (externally), narrow portion of ridge 304 called a fulcrum junction 305. Fulcrum junction 305 presses into a little finger knuckle recess 15, an area outward of and lower than the end point of lower transverse crease 11, against little finger knuckle 41 at the bottom of the hand, little finger knuckle recess 15 created during tightening of the grip as the portion of little finger knuckle 41 at the back side of the hand rotates outwardly (away from lower transverse cease 11) and a muscular, fleshy area rises just above lower transverse crease 11 creating bank 13 which is the most outward portion of fleshy ridge 14. Bank 13 of fleshy ridge 14 must be "locked in" or "pinched off" (blocked) at a critical area just outward of the lower transverse cease 11 which is the edge of primary contact point 306 in FIG. 21, called ridge/lock 303 seen internally arcing to meet fulcrum junction 305. Ridge/lock 303 locks in the hand's bank 13 serving to block outward movement of tough ball 38 and 39 during phase two of the grip thus blocking the relative inward movement of little finger knuckle 41 serving to maintain handle 48 in its outward finger grip, preventing inward role of handle 48 possibly giving more flight to a baseball and giving the fingers "something to pull against" (greater power in the lower fingers), fulcrum junction 305 also being the main area of fulcrum leverage for lever 308.

One may discover and understand the above by pressing one's left thumb (representing ridge 304) inward against the right hand's lower tough ball 39 in the area of transverse crease 11, while placing the left hand's index finger in the right hand outward of the knuckles as though a handle, then squeezing the handle (finger) and noticing the bank 13 rising above lower transverse crease 11 and being pinched off by pressure on the index finger which represents the bridge 340 and primary contact point 306 under the handle (finger). Notice the handle (left finger) is kept out in its finger grip, whereas removing the thumb (ridge 304) allows the hand to slide under the finger, allowing the finger (handle) to move inward.

Fulcrum platform 302 arcs slightly interiorly (upwardly) against the hand's lower tough ball 39 (most upwardly at fulcrum junction 305 of ridge 304) extending outwardly near the back side of little finger knuckle 41 and wrapping partially due to glove pressure to the back side of hand 12. Integrally attached to and rising upwardly from fulcrum platform 302 is bridge 340 ending in the mid-palm area. The area of integral attachment called lever 308 is a somewhat thickened length arcing exteriorly (away) from tough ball 38 extending inwardly from near the back side of little finger knuckle 41 at connection 311 past integrally connected primary contact point 306 (seen externally in FIGS. 20 and 25), past ridge 304 (seen internally in FIGS. 21 and 22). Lever 308 then continues past (inward of) fulcrum platform 302 reversing to an internal arc at a thickened portion of thumb base/wrist anchor 350 being a wrist fulcrum 351, the area of attachment of swivel 330. Primary contact point 306 is an integral portion of lever 308 and bridge 340, thinning outwardly at connection 311 with little finger attachment 312 and upwardly with bridge 340.

The location and composition of lever 308 is critical to the success of direct contact stress absorption. If the pathway of lever 308 towards thumb base/wrist anchor 350 moves upwardly (as in embodiment 203) angling over tough ball 38 with too much thickness, even though a tough area, discomfort from direct pressure of handle 48 will occur. The pathway of lever 308 must be as low as possible while still reaching its junction with thumb base/wrist anchor 350 (also at the lowest point allowed by stress receiving area wrist hollow 75), such that lever 308 runs primarily along the bottom of tough ball 38 (not supported by tough ball 38) but supported by fulcrum platform 302 anchored at lower tough ball 39 and "locked" into fleshy relocation channel 309, actually serving to "widen" the hand. Refinement of portions of lever 308 make hand accessory 300 workable with all types of bottom hand gripping of a baseball bat and are further explained in a final paragraph on "bottom hand gripping". A portion of the internal side of lever 308 is the hollowed fleshy relocation channel 309 which is filled by the hand's fleshy ridge 14 and bank 13, pressed lower by the angle of connection with bridge 340 held tight by ridge lock 303 where increased pressure from handle 48 occurs as recoil begins and gripping pressure tightens in phase three grip. A thickened lever portion 309 of lever 308, seen internally (FIGS. 21 and 22), extends from the area of swivel 330 above and partially defining relocations channel 309, outwardly dispersing to thinned bridge 340, lever portion 309 is also integrally connected with the thickened wrist fulcrum 351, thus combining in strength at the "lifting/prying" end of lever 308.

Lever 308 arcs externally away from the hand 12 in the area from primary contact point 306 to swivel 330, then reverses, arcing internally at wrist fulcrum 351. During the above described phase two hand movement (downwardly and forwardly toward little finger knuckle 41) the distance between the areas of hand 12 which are contacted by thumb base/wrist anchor 350 and primary contact point 306 lessens. This shortened space within the hand was the source of many problems in previous embodiments. The shortened space problems have been overcome in roughly four ways. One, because the upper area of the hand is now "locked in" to lifeline anchor 310 it no longer bumps or slides past the tough ball anchor or bridge, but channels force through swivel 330 causing lever 308 to "pop out" (flex further away from hand 12), arcing bridge 340 outwardly not only partially accounting for the reduced grip space, but serving to further increase the strength in the area of primary contact point 306 and bridge 340, increasing the amount of stress absorption of embodiment 300. Two, connection 311 between little finger attachment 312 and primary contact point 306 allows lever 308 to move slightly forward with a portion of primary contact point 306 of lever 308 moving slightly past little finger attachment 312 outward and downward of the lowest area of little finger knuckle 41 not only helping to solve the space problem but enlarging the width of the griping hand in support of the handle 48, at the proper angle to handle 48, without interfering with the thumb of the bottom hand (pressing against the top hand when holding a baseball bat) or, in the case of bottom hand usage, not interfering with the knob of handle 48. Three, swivel 330 allows tough ball anchor 310 to move inwardly relative to lifeline anchor 310 moving outwardly, and four, the "reduced grip space" itself has been lessened by fulcrum junction 305 of relocation channel 309 blocking forward movement of the lower hand at a certain point, all the above working in concert. [Note: Once permanently mounted within a glove, it is possible for connection 311 to be anchored directly to the glove without the need for little finger attachment 312.]

Figure 21:
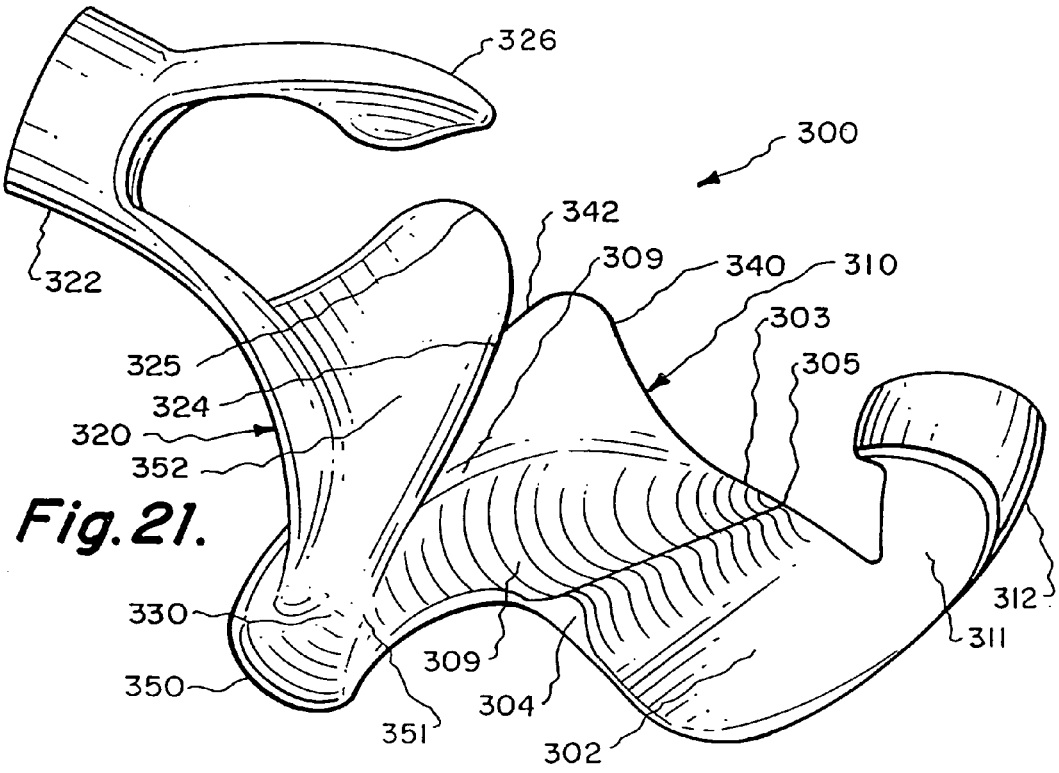
FIG. 21 is a back elevational view of the sixth embodiment of hand accessory of this invention with a fulcrum platform held open for internal viewing.
Figure 22:
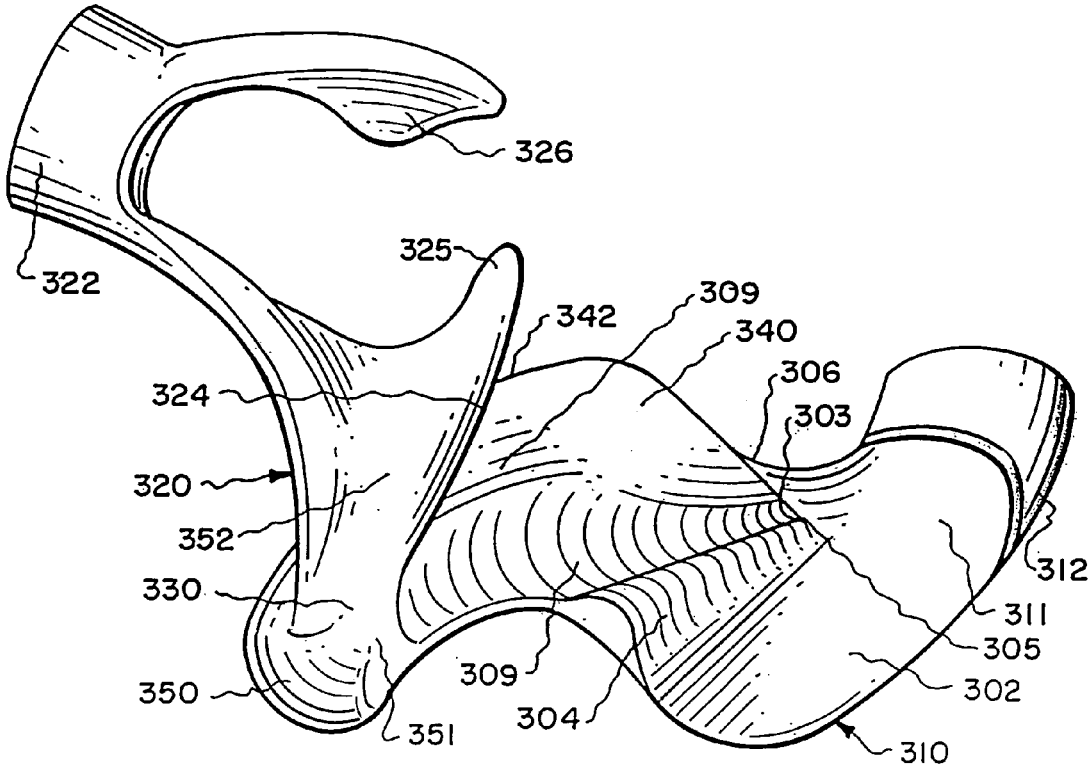
FIG. 22 is a view similar to FIG. 21 but of a modified form of hand accessory of this invention.
Figure 23:
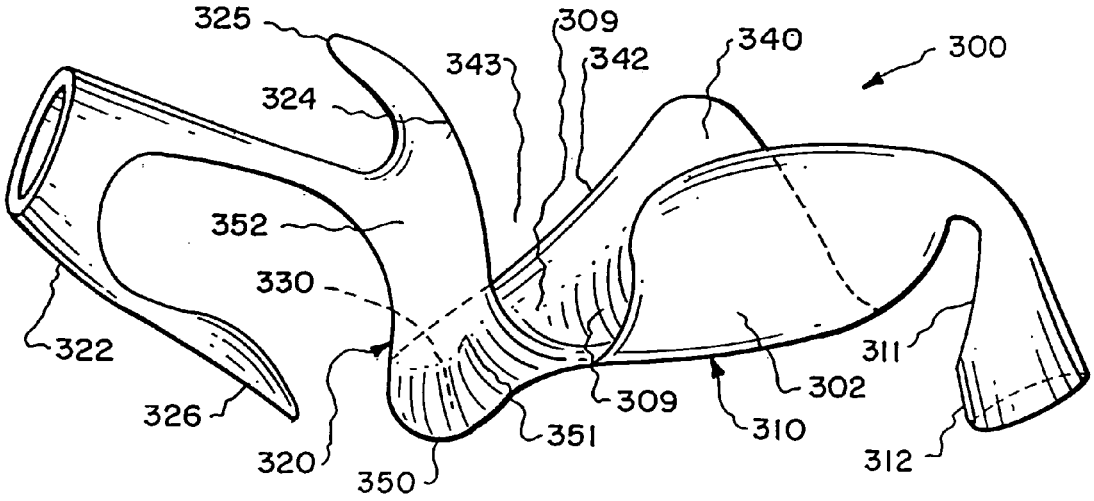
FIG. 23 is a view similar to FIG. 21 but with a modified lifeline anchor angled differently at a swivel and the fulcrum platform in its natural position (closed) when angled downward.
Figure 24:
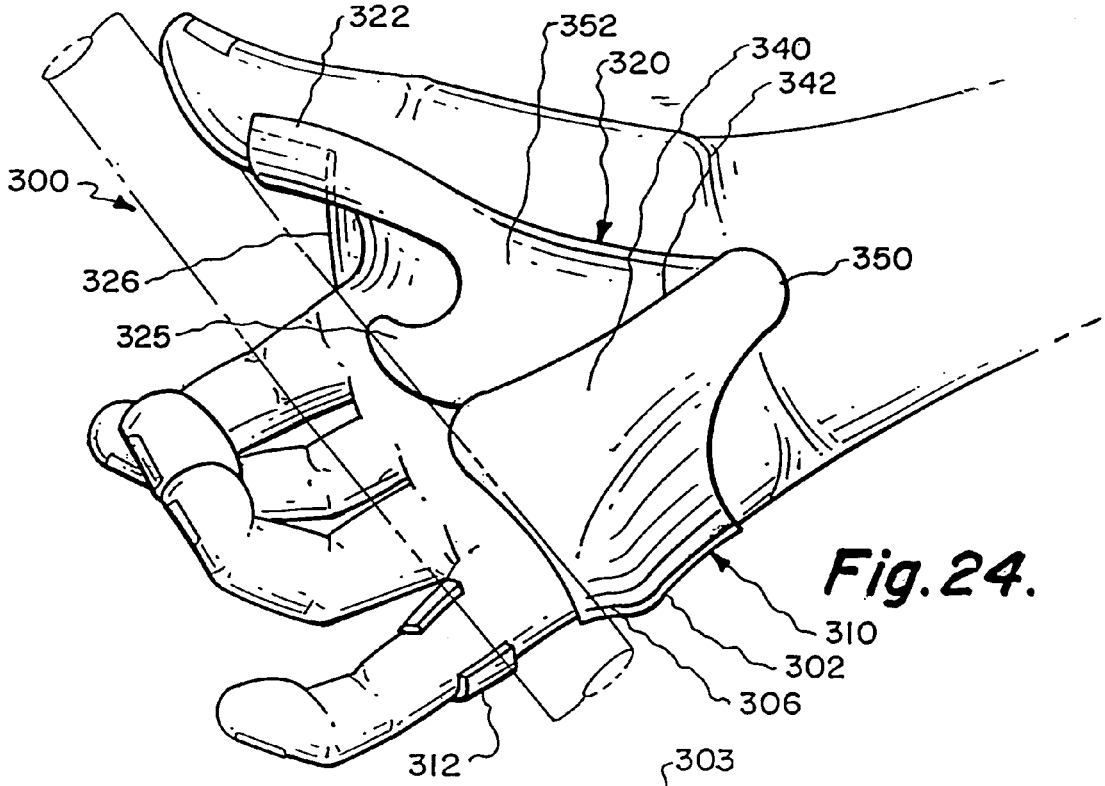
FIG. 24 is an isometric view of the sixth embodiment of hand accessory of this invention showing such mounted within an open hand.
Figure 26:
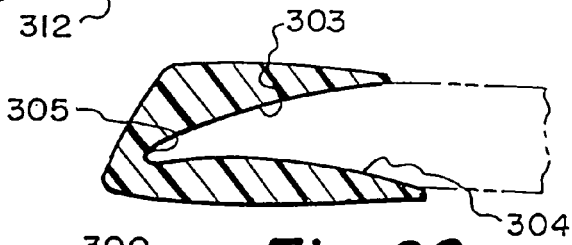
FIG. 26 is a cross-sectional view of hand accessory of this invention taken along line 26-26 of FIG. 25.
Figure 25:
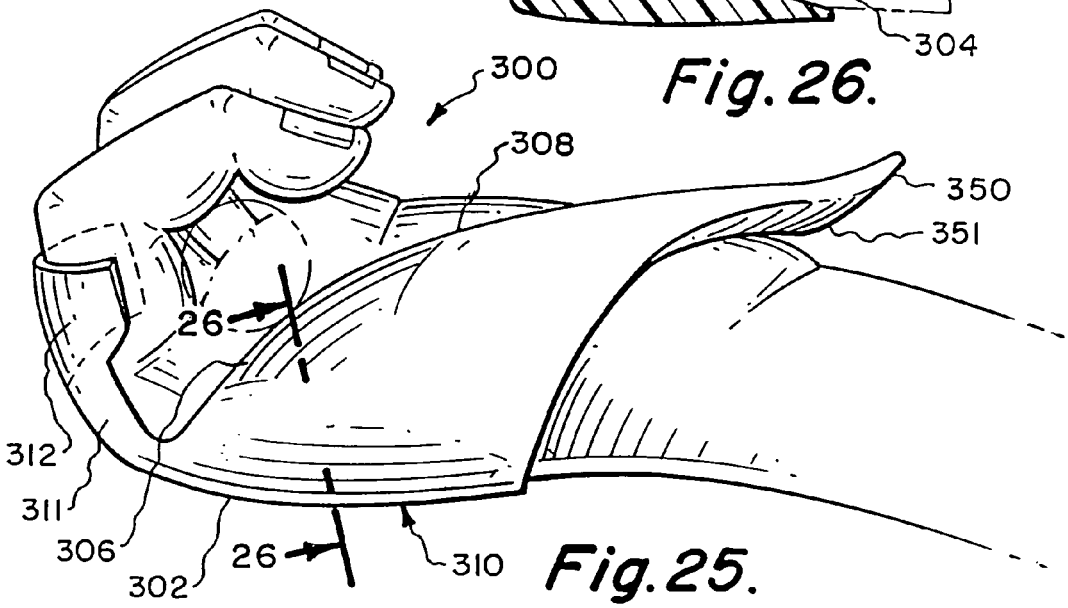
FIG. 25 is an end view of the sixth embodiment of hand accessory of this invention depicting the position of a hand closed about the implement handle.

The primary contact point 306 is the narrowest area of bridge 340 yet it is the initial contact point and thickest direct contact stress receiving area between handle 48 and sixth embodiment 300. (See previous embodiment 203 for elaboration on the concept of the primary contact point, the structure in 300 being much improved.) Primary contact point 306 is integrally connected to bridge 340, lever 308, fulcrum platform 302 and internally to ridge/lock 303. As seen in FIG. 21, ridge/lock 303 is a portion of an outer edge of primary contact point 306 arcing from bridge 340 downwardly to fulcrum junction 305 thinning becoming connection 311 connecting to little finger circular attachment 312. A modified version of connection 311 is depicted in FIG. 22 wherein the outer edge of primary contact point 306 extends from the upper area of ridge/lock 303 almost directly outward contouring the little finger knuckle 41 to little finger circular attachment 312. In this version primary contact point 306 is thicker in the area externally and outward of ridge/lock 303, providing added cushion for some types of gripping but less flexibility. Primary contact point 306 extends upward from ridge/lock 303 thinning along lower transverse crease 11 as bridge 340, bridge 340 thence extending inwardly along bridge glide 342 to and past swivel 330 becoming lever 308 ending at thumb base/wrist anchor 350. Hand accessory 300 is constructed so that thumb base/wedge 352 presses and moves against bridge glide 342 providing support, however contact in the current model is minimal occurring more with bottom hand usage as the thumb moves thumb base/wedge 352 lower to a more supporting position. Bridge glide 342 is held above the hand's sensitive mid-palm 28 less by thumb base/wedge 352 than the structure itself in the following ways. One, wrist fulcrum 351 which rotates (pries) swivel 330, lever 308 and bridge 340 away from sensitive mid-palm 28 as a result of rotational pressure from an external glove at the end of thumb base/wrist anchor 350, two, the structure within fulcrum platform 302 allows most stress reception to occur at the hand's lower tough ball 39 and wrist hollow 75 as well as locking in tough ball anchor 310 and angling handle 48 at a slight tilt away from the hand's sensitive mid-palm, and three, external and downward rotational force exerted on bridge 340 through swivel 330 from upward movement of the thumb, all the above working in concert.

The location and structure of swivel 330 is also critical. In order to gain the best leverage, swivel 330 must be located in the highly sensitive area of the metacarpals, appearing to be adjacent bony lifeline 27. Location further forward reduces leverage gained from forward movement of the thumb, further inward causes a number of problems, such as forward thumb movement causing lifeline/web contact 325 to move away from lifeline 36/web 32, and also a buckling of thumb base/wedge 352 thus discomfort to thumb base 30. Elimination of pressure from swivel 330 against bony lifeline 27 is accomplished primarily by wrist fulcrum 351, the thickened portion of thumb base/wrist anchor 330 which arcs against the hand's wrist hollow 75, a good stress absorbing area roughly one inch inward of bony lifeline 27, the arc continuing inward becoming external of wrist 74 when no glove pressure is applied such that pressure from an outer glove drawn tight at the wrist 74 presses against the thinned end of thumb base/wrist anchor 350 creating a rotation of hand accessory 300 outward of wrist fulcrum 351, lifting swivel 330, bridge 340 and lever 308 away from sensitive areas of hand 12, thus absorbing stress at the wrist while holding the handle out in the fingers. Swivel 330 has to be large enough to transfer power between tough ball anchor 310 and lifeline anchor 320, but flexible enough for the two structures to travel in different directions and prevent the bulging, forward moving thumb base 30 from displacing lifeline contact 324 from its anchoring area. Thus pressure from handle 48 causes lifeline/web contact 325 to press deep within the lower web 32 of gripping hand 12 "locking in" the thumb, influencing the fingers to not pull sensitive thumb knuckle 34 toward the handle 48, giving the lower fingers 16 and 40 an anchoring area to pull against increasing power in the lower area of the hand 12 and wrist 74, as lifeline/web contact 325 is also a pivot area, stabilizing index knuckle 56 and thumb knuckle 34 away from each other, the hand 12 closing more as a pivot at the finger area, spacing thumb knuckle 34 a further distance from handle 48 than without hand accessory 300.

Bottom hand grip: Because of the above described solutions to previous thumb movement problems, current embodiment 300 is workable on both top and bottom hands in swinging a baseball bat. Several previous embodiments were fairly well received by baseball players for the top hand, but had two basic problems for use in the bottom hand. First, as described previous, in bottom hand gripping the thumb moves lower than in the top hand grip, which creates more stress on the thumb if structure is present, and the reducing distance causes buckling of the structure. Secondly, the whole tough ball area of previous hand accessory 203 (See FIG. 16, lever 224) was too thick especially in the area of tough ball 38, and it interfered with the knob end of the bat as the bat pivoted within the bottom hand. With power being generated from upper areas of the hand at lifeline anchor 320, and more importantly anchoring improvements in tough ball anchor 310 especially ridge 304 and ridge/lock 303, a much thinner and more flexible hand accessory 300 allows the knob of handle 48 to glide smoothly while still protecting the hand's sensitive bony heel 43 (hamate bone). Bridge 340 also accommodates direct contact with the knob of the handle if the batter chooses an overlapping grip (little finger below the knob), protecting the sensitive bony heel 43 of the hand. One last refinement was necessary to make hand accessory 300 workable with all types of gripping. The described thickened junction lever 308 in the area of lower tough ball 39 without much refinement is excellent for gripping bar bells, bicycle handle bars and top hand gripping in baseball, and can be passable for bottom hand gripping in baseball if the hand is flush with the knob (or overlapped) such that the edge of the pivoting knob slides smoothly along the lever 308. Some hitting coaches, however, teach to angle the bottom hand grip such that the little finger knuckle is often above the knob which causes the knob to be half on and half off lever 308 which may create a slight obstruction to the pivoting knob. Thus, a reduction of thickness especially in certain lower areas of lever 308 and a slight re-angling was necessary. The re-sloping achieved and a loss of strength compensated by the shape and angle of ridge 304 and fleshy relocation channel 309 providing a hand accessory 300 workable for all types of gripping and swinging of a baseball bat.

CIP seventh embodiment 400 (FIGS. 27-35) of hand accessory consists of a tough ball anchor 410 which receives direct contact with handle 48 absorbing major stress in the lower hand, an upper hand anchor 420 receiving some direct contact and absorbing minor stress, and a junction between the two, mid-palm anchor 415 receiving almost no direct contact while absorbing a substantial amount of stress.

Thumb/glove attachment 422 of upper hand anchor 420 connects as a circular attachment to the first joint of thumb 44 only when a glove is separately pulled over the hand 12, removed area, space 423 reducing the circular thumb attachment 422 to a partial circle pressed against the thumb first joint when fixed within a glove. Likewise little finger/glove attachment 412 of tough ball anchor 410 is reduced to a partial circle at space 413 when fixed within a glove allowing handle 48 to move flush with little finger 40, little finger/glove attachment 412 being fixed between the little finger second and third joints.

Upper hand anchor 420 and mid-palm anchor 415 (FIGS. 27 and 28): Extending from an upper area of thumb/glove attachment 422 past thumb second joint 34 toward upper web 46 is thumb/handle spacer 416 thickening at upper web relocation press 417 which pressed by an external glove anchors snugly in the upper web 46 seen from the rear of the hand. Extending from a lower area of thumb/glove attachment 422 downwardly and inwardly is thumb flex 454 which is integrally attached to mid-palm anchor 415 between web relocation press 419 and thumb base/lifeline anchor 452. A thin strip, web anchor 418 extends from web relocation press 419 upwardly along transverse crease 10 then inwardly, thickening gradually to upper web relocation press 417. Thumb flex 454 allows full downward movement of thumb 44 while adding internal pressure to mid-palm anchor 415 aiding in pressing lifeline/web anchor 425 deep within the hand's lifeline 36 and lower web 32, thus mid-palm anchor 415 anchors with greatest depth at the area of lifeline/web anchor 425, a primary stress receiving area of the upper hand. The point of greatest depth of lifeline/web anchor 425 is web point 426 pressing into the lowest portion of the lower web 32 just above the area felt to be the intersection of the index tendon and thumb bone, that deepest area of the lower web 32 only available when the thumb is in an "open" position maintained by a restricted phase three grip (explained in more detail following).

Figure 33:
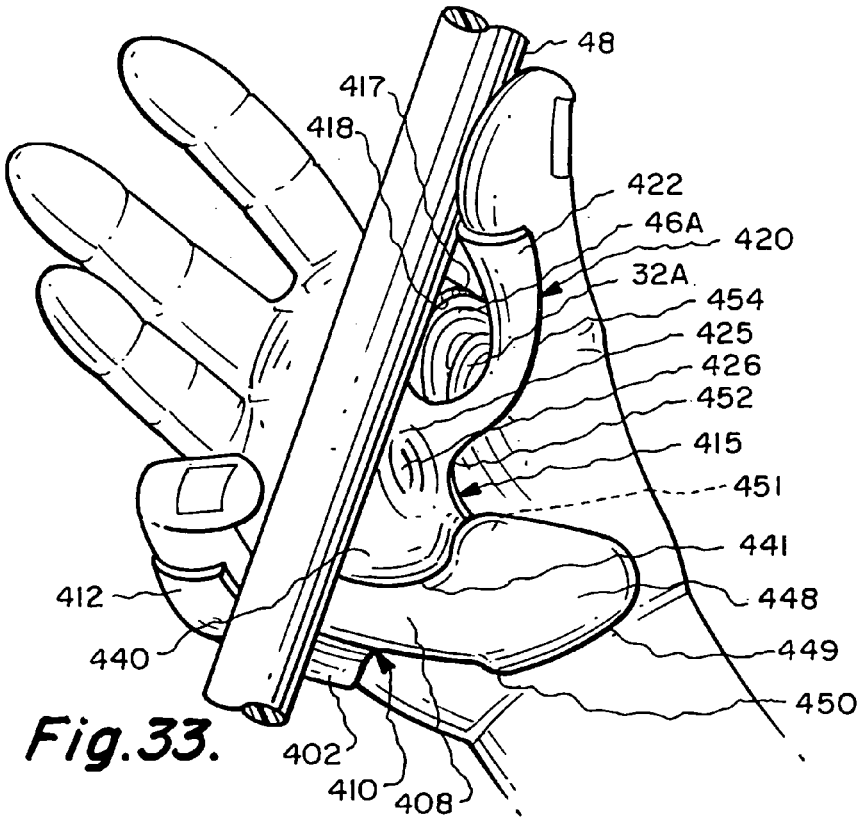
FIG. 33 is a view similar to FIG. 32 but where a handle is included.
Figure 34:
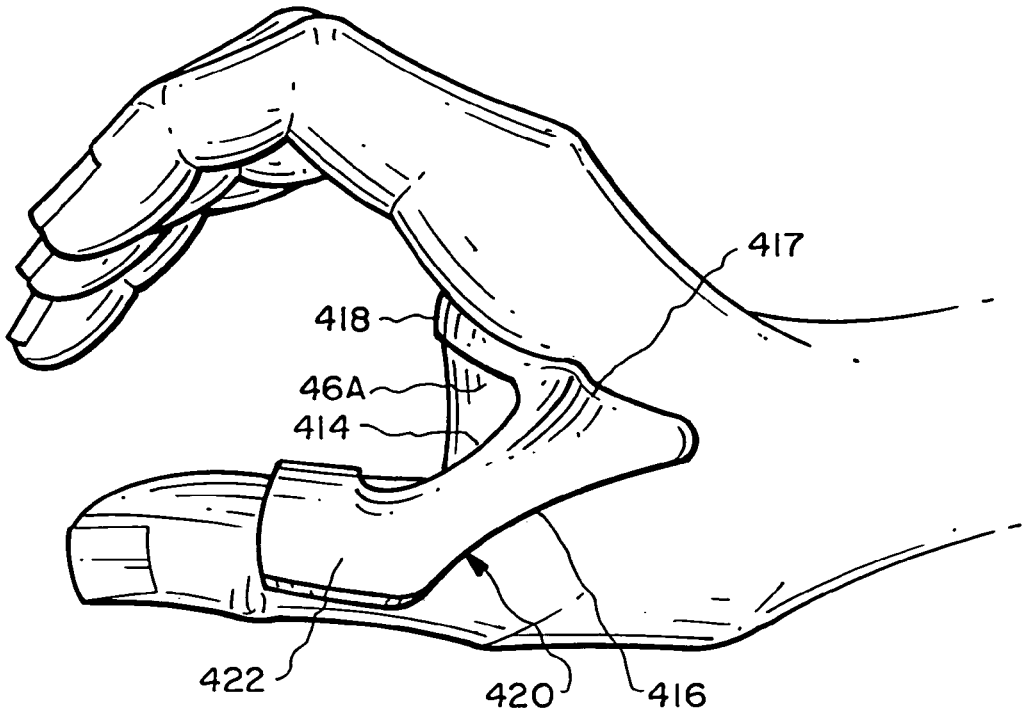
FIG. 34 is a top elevational view of the hand in FIG. 32.
Figure 35:
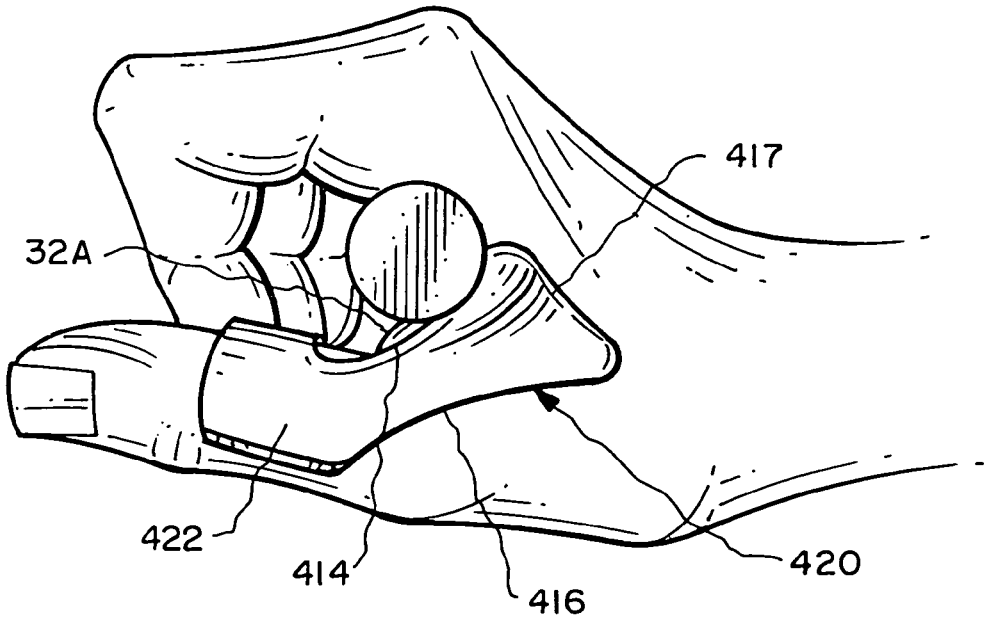
FIG. 35 is an end elevational view of the hand in FIG. 33.

Without hand accessory 400, handle 48 recoiling or resting in the upper hand will push web area 32 to 46 downwardly/inwardly toward index knuckle 56 exposing thumb joint 34 to injury from handle 48. A major feature of embodiment 400 is a relocated lower web 32A whereby lower web 32 is pressed inwardly/upwardly spacing handle 48 away from thumb joint 34. A skin relocation originates at web point 426 and moves in two directions, the skin moving with mid-palm anchor 415 downwardly when gripping, the skin being displaced by mid-palm anchor 415 upwardly, that is, pressure from the gripping hand at lifeline/web anchor 425 pushes mid-palm anchor 415 pressed as one with the hand's thin palm skin downwardly moving into the tough ball area adding bulk to tough ball areas 38 and 39 increasing support of bridge 440, more importantly, the anchoring depth of lifeline/web anchor 425 displaces fleshy lower web 32 upwardly toward thumb joint 34 partially overlapping and protecting the thumb joint (FIGS. 33 and 35). Added pressure on web relocation press 419 from handle 48 effects even greater fleshy displacement (relocation) toward thumb joint 34, thus the fleshy web itself (relocated lower web 32A) serves to overlap and protect the thumb joint from bruising, with handle 48 itself aiding in the protection of thumb joint 34 from handle 48.

Web anchor 418 receives direct contact with handle 48 and when combined with the surrounding structure is a good secondary stress receiving area, aided by upper web relocation press 417 pressing and displacing the fleshy upper web 46 downwardly (relocated upper web 46A) under web anchor 418, bulking and adding cushion under web anchor 418 (FIGS. 33 and 34), eliminating the discomfort of any stress from a recoiling bat or heavy handle which has not been dissipated by lower structure in hand accessory 400. The combination of thumb/handle spacer 416 acting partially as a spacer braced by web anchor 418 results in a pivoting at web anchor 418 carrying thumb movement away from handle 48 (the thumb in an "open" position) protecting thumb joint 34 and allowing more power to be harnessed as the thumb base travels forward in a wider more circular path, transferring more strength to bridge 440, the thumb 44 pivoting forward more at the third joint (thumb base 30) than the second joint 34 and more in conjunction with movement of the whole hand at the area inward of the transverse crease moving forward, first downwardly (phase two) then upwardly (phrase three).

Another benefit gained from upper hand anchor 420 is leverage directly against handle 48 in two areas (FIGS. 33 and 35): the leading side of thumb flex 454 at its connecting area with mid-palm anchor 415 having a slight "shearing force" against handle 48 (as in fourth embodiment 182), and more importantly, the leading side of thumb/handle spacer 416, being thumb lever 414, may have significant direct contact with handle 48 depending on the grip, leveraging the handle toward the finger area away from thumb joint 34 especially at the start of phase three. Though intended for "finger gripping", the present embodiment 400 is now workable and beneficial in all types of gripping for both top and bottom hands.

The previous difficulty in tapping power from lower web 32 was due primarily to the loss of space available for anchoring structure as the thumb 44 moves forward and upward completing phase three grip, any structure being in the area of web 32 creating either discomfort to the thumb bone and thumb joint 34, and/or index knuckle 56 and/or the tendon of index finger 20 running through the mid-palm 28. Success now achieved in gaining support from lower web 32 is largely the result of embodiment 400 preventing full phase three grip allowing more space for hand accessory material. Thus thumb redirection, fleshy relocation at lower web 32 and upper web 46, direct handle contact and some stress absorption at web anchor 412, thumb lever 414 and thumb flex 454 all are factors and features working truly synergistically in the prevention of bruising to thumb joint 34 and the transferring of stress to not only tougher, but stronger receiving areas than without hand accessory 400.

In addition to the above described means of limiting phase three movement, the dimensions of tough ball anchor 410 also contribute by reducing the distance between thumb base/wrist anchor 450 and primary contact point 406 angling upper hand anchor 420 further away from handle 48, thus embodiment 400 is designed to fit a partial phase two grip, the hand in a "cocked" position whereby the lower hand has moved forward/downward relative to the upper hand moving backward (inward/upward), the design not encouraging a full phase three grip, the natural tendency of thumb joint 34 to move sideways/forward towards the handle 48 not being necessary and the full movement of the upper hand toward the handle (end of phase three) not being beneficial, and the "shortened space problem" (described in embodiment 300) completely overcome by the above explained reduction of distance in combination with the external arcing of bridge 440. (More under "tough ball anchor" specs.)

Note: The terms "tapping power" from an area or "gaining support" from an area are mostly interchangeable with "absorbing stress" in an area. All areas of the hand 12 are able to absorb varying degrees of stress, the goal of this invention being to distribute stress from handle 48 to each area of the hand in the most beneficial degree.

Once full stress absorption was gained from lower web 32 at lifeline/web anchor 425, surrounding areas capable of receiving lesser degrees of stress were more successfully contacted. Extending from the lowest area of thumb flex 454 at the inside edge of mid-palm anchor 415 downward toward the metacarpals is thumb base/lifeline anchor 452. Transitioning now to tough ball anchor 410: Further downward along the structure of thumb base/lifeline anchor 452 at the inside edge of bridge 440 is bony lifeline anchor 451, the contiguous area between anchors 452 and 451 anchoring securely during gripping in the hand's lifeline 36 at the extreme lowest portion of thumb base 30, gaining power from the strongest area of the thumb while allowing full downward movement, not impinging on or stressing the thumb.

Another aspect of phase three movement not previously explained is a reduction of lifeline space widthwise, described as a lifeline/web narrowing, which is caused by the thumb's forward/downward movement at the third joint appearing to be an internal collapsing along the lifeline (like an accordion being squeezed). The above described structure, in particular the contiguous area of bony lifeline anchor 451 and thumb base/lifeline anchor 452 filling the hand's lifeline 36 serve to reduce the lifeline/web narrowing, spacing the thumb a further distance from the handle 46. Since lifeline 36 is spaced open by the structure (not collapsing) the described thumb movement carries hand movement past (below) lifeline 36 exerting force at mid-palm anchor 415 toward tough ball anchor 410 bulking the hand's tough ball area 38 and 39, all serving to transfer power to tough ball anchor 410, in particular bridge 440.

Tough ball anchor 410: Although lying in a more sensitive area, bony lifeline anchor 451 thickens in order to support bridge 440, the thickened area contouring bony lifeline 27 inwardly ending at thumb base/wrist anchor 450, stress received in the hand's bony lifeline 27 being reduced by the previous described surrounding structure and by thumb/lifeline buffer 448 which is angled to allow full downward movement of the thumb without pushing bony lifeline anchor 451 externally out of position, while receiving a minor amount of stress at upper thumb base 31 thus reducing stress to bony lifeline 27. Also, glove pressure against thumb/lifeline buffer 448 provides a minor amount of fleshy relocation towards the lifeline area, both factors acting as a buffer against thickened bony lifeline anchor 451. Thumb/lifeline buffer 448 also provides added stability to bridge 440 in combination with thumb base/wrist anchor 450 anchoring into wrist hollow 75 and wrist anchor 449 under glove pressure pressing against the wrist 74 just below (inside) thumb base 30.

Little finger attachment 412 is integral with little finger connection 411 inwardly and fulcrum platform 402 downwardly. Little finger connection 411 and fulcrum platform 402 are integral with primary contact point 406 which is the greatest load bearing portion of bridge 410, being supported by fulcrum platform 402 and all surrounding structure. Lever 408 of bridge 440 extends from primary contact point 406 to thumb/lifeline buffer 448 at bony lifeline anchor 451 and thumb base/wrist anchor 450, all areas being integral, the upper area of both lever 408 and thumb/lifeline buffer 448 angling externally as one toward handle 48, the upper portion of bridge 440 angling from bridge/palm angle 441 internally becoming flush against the hand's mid-palm 28 and becoming mid-palm anchor 415 at the area of thumb base/lifeline anchor 452, bridge/palm angle 441 being a thickened, upper area (border) of lever 408 in combination with bony lifeline anchor 451 (seen internally) supporting bridge 440 above the hand's bony heel (hamate bone), lever 408 integrally attached at its lower border with fulcrum platform 402 at a roughly ninety degree extension from lever 408 (also wrapping under glove pressure) to the back side (rear) of the hand, creating a sharper angle of extension.

Figure 27:
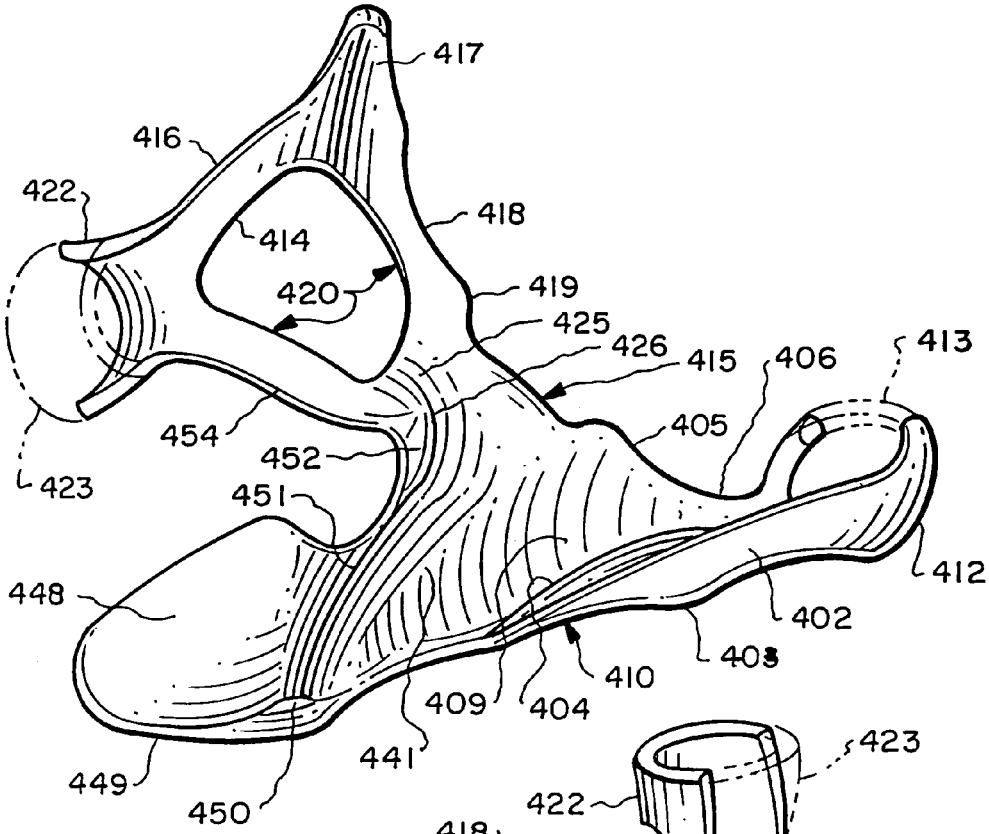
FIG. 27 is a back elevational view of the seventh embodiment of hand accessory of this invention.
Figure 28:
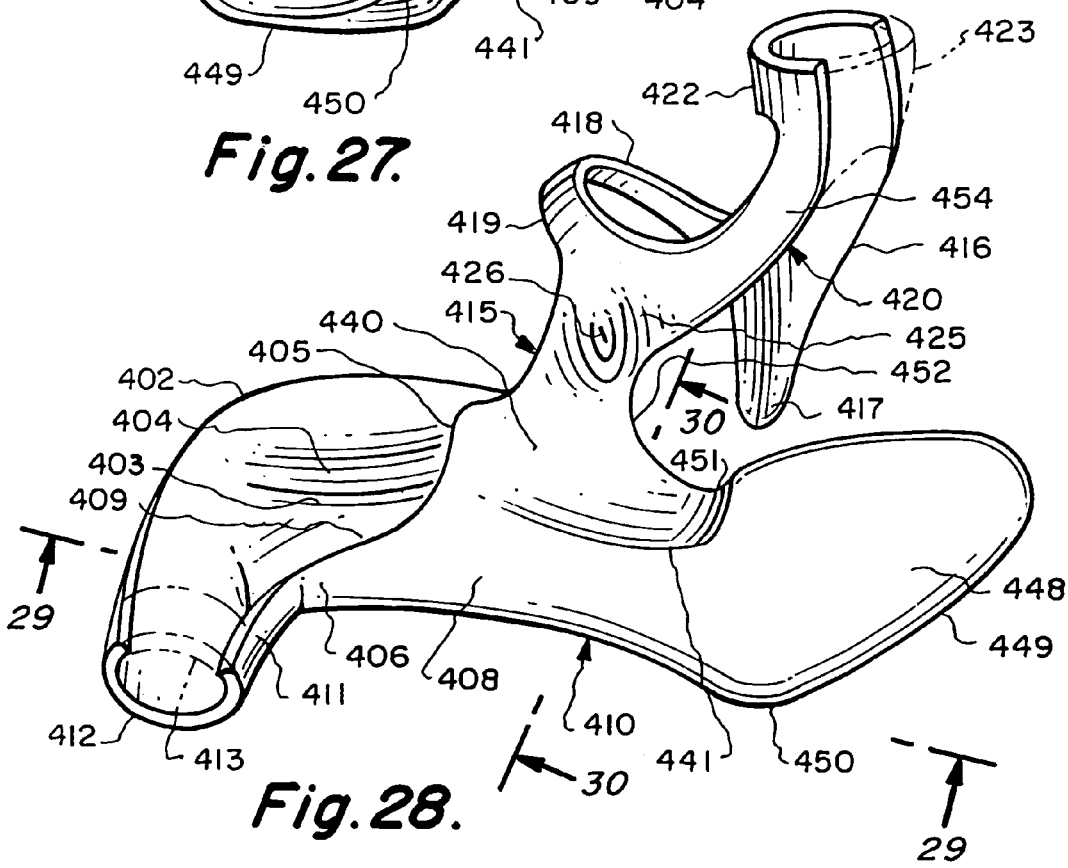
FIG. 28 is a front elevational view of the seventh embodiment of hand accessory of this invention.
Figure 29:
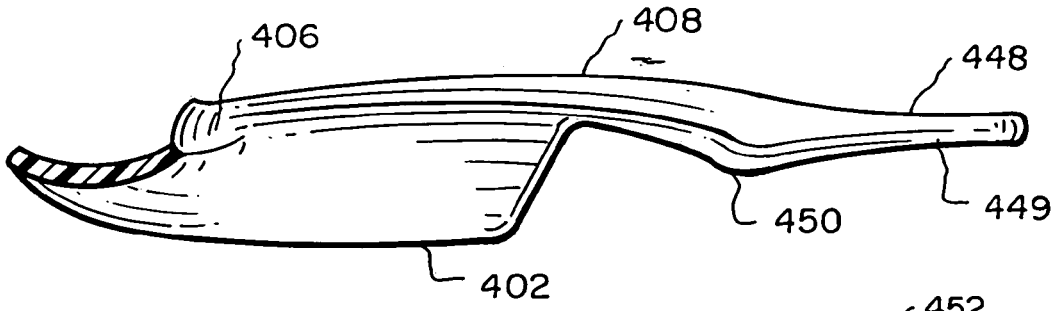
FIG. 29 is an bottom view, partly in cross-section, of the seventh embodiment of hand accessory of this invention taken along line 29-29 of FIG. 28.
Figure 30:
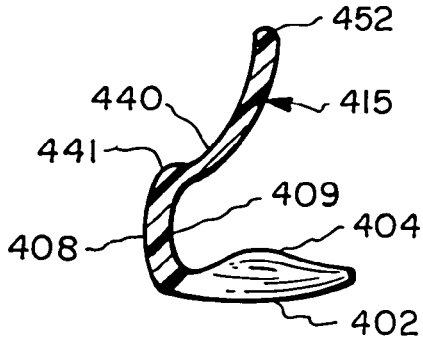
FIG. 30 is a cross-sectional view through a part of the seventh embodiment of hand accessory of this invention taken along line 30-30 of FIG. 28.
Figure 31:
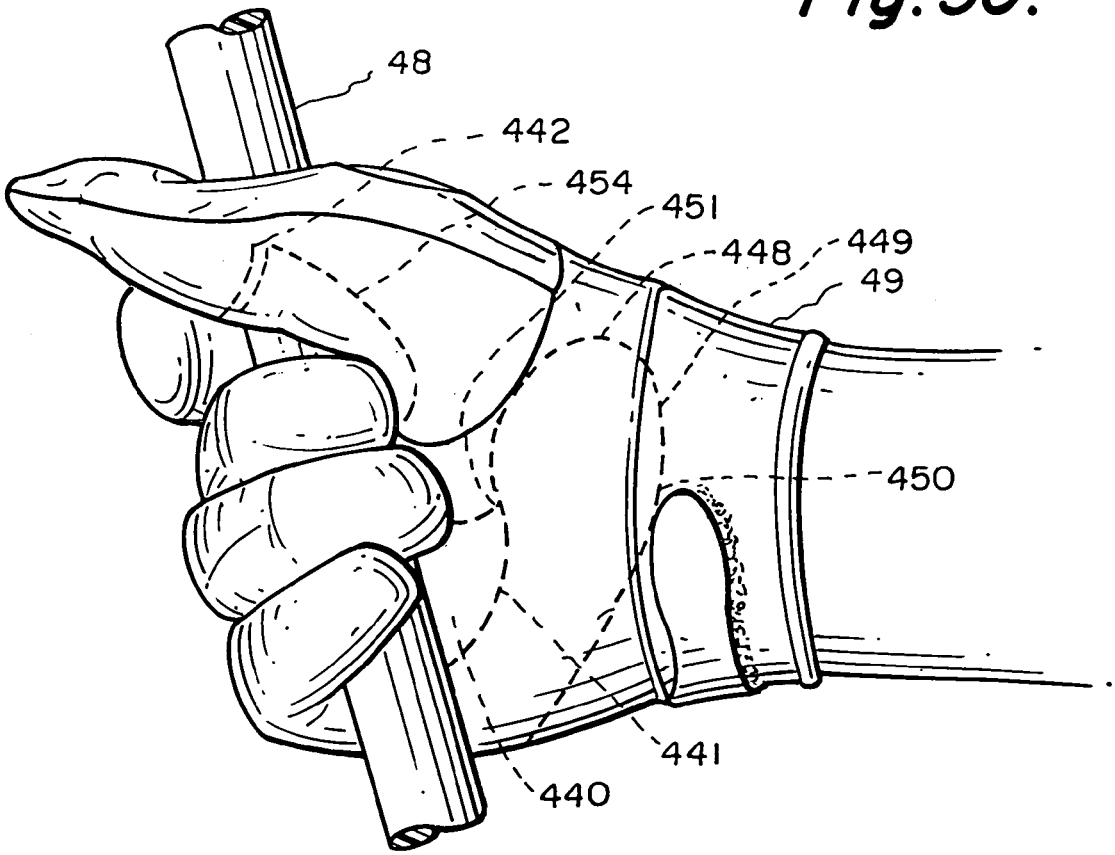
FIG. 31 is an elevational view of a human hand wrapped about a handle where the hand is wearing a glove and the seventh embodiment of hand accessory is located within the glove.
Figure 32:
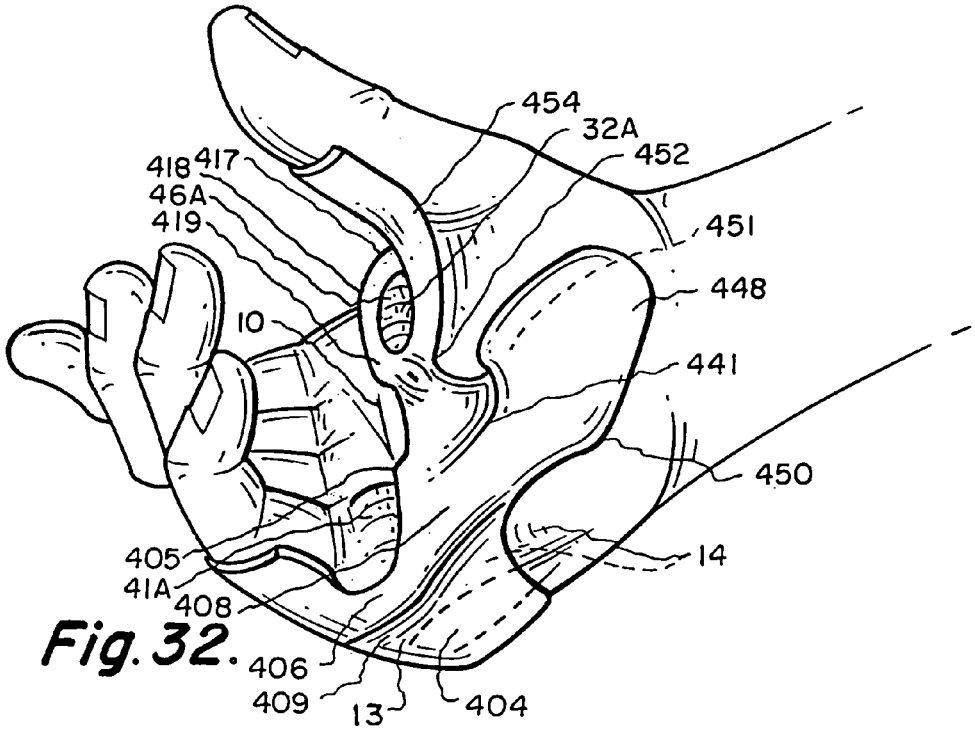
FIG. 32 is an elevational view of a human hand on which is mounted the seventh embodiment of hand accessory.

Lever 408 not only arcs externally (toward and against handle 48) widthwise, (FIG. 30) and lengthwise (FIG. 29), but also upwardly (internally) seen as a crescent from primary contact point 406 to thumb base/wrist anchor 450 (as viewed from the front, FIG. 28), the upward crescent of lever 408 creating an internal arc at fulcrum platform 402 pressing into the lower tough ball 39. Ridge 404 of fulcrum platform 402 pressed by an external glove upward (internally) increases the arcing pressure of fulcrum platform 402 pressing into the lower tough ball 39 increasing the displacement of fleshy area (repositioned fleshy ridge 14) externally (toward handle 48) producing bulking support of handle 48. Handle 48 pressing internally on lever 408 presses the area of fleshy bank 13 and repositioned fleshy ridge 14 downwardly (FIG. 32) overlapping ridge 404 and filling fleshy relocation channel 409 creating a "wider hand" (a lower area of support for handle 48), fleshy relocation channel 409 being internal of primary contact point 406 and lever 408 at their integral connecting area with fulcrum platform 402 (FIGS. 27, 30 and 32). Ridge 404 not only relocates the fleshy lower tough ball 39 into a more supporting position of handle 48, it acts as overall support for tough ball anchor 410 and as a fulcrum (or pivot) for lever 408. Ridge 404 arcs toward primary contact point 406 to its apex and thickest area being ridge fulcrum 403 pressing into the hand's little finger recess 15 between the little finger knuckle and the end of lower transverse crease 11 and felt as the major pivoting area for lever 408. Another benefit of the upward, internal arcing fulcrum platform 402 and lever 408 is the creation of a straighter (more direct) and powerful lever 408 between primary contact point 406 and thumb base/wrist anchor 450.

The dimensions of tough ball anchor 410 are such as to accommodate a phase two grip (which generates most of the bat speed) restricting the completion of phase three grip which is the position which produces thumb bone bruising, thus with hand 12 in an open position (not gripping, see FIG. 32), thumb base/wrist anchor 450 would be adjacent bony heel 43 (short of its intended position), but when the hand grips (its natural position when wearing batting gloves, see FIG. 31) the thumb base/wrist anchor 450 presses snugly into wrist hollow 75. Should a batter force his hand into a complete phase three grip, the hand moving fully upward (such as being "jammed" by an inside pitch), thumb base/wrist anchor 450 would again move somewhat outward/downward of wrist hollow 75, but short of (inside of) bony heel 43. To better explain, restriction of phase three is more than just restricting thumb movement, it is restricting the full upward movement of the whole area of the hand inside of the transverse crease, accomplished primarily by thumb/handle spacer 416 and surrounding previously defined structure, and it is restriction of a certain amount of forward movement of the upper hand (maintaining the more powerful "cocked" position) which is accomplished partially by the following less obvious structure: Extending from the outward edge of primary contact point 406 contouring the little finger knuckle inwardly and thinning upwardly at the lower transverse crease 11, knuckle lock 405 rests on the fleshy bank 13 "locked" in the lower transverse crease 11 by the overlapping fleshy surface 41A of little finger knuckle 41 during gripping (FIG. 32), knuckle lock 405 helping stabilization such that when gripping pressure occurs two benefits result: 1) Like squeezing a balloon near the top makes the bottom bulge out, pressure from the hand at mid-palm anchor 415 creates a bending (downward arcing) at primary contact point 406 widening the effective gripping area providing more bridging structure for support of said handle, and 2) knuckle lock 405 being blocked from forward movement creates inward and internal pressure at lifeline/web anchor 425 serving to reduce the outward (forward) movement of the upper hand restricting completion of phase three grip protecting thumb joint 34 and transferring power to the bridge. Thus, the various structure of hand accessory 400 serve to increase the benefit of opposing structure and surrounding structure.

What is claimed is:

1. In combination with a handle of an implement when said handle is to be manually swung in motion by the hand of a human with the hand gripping and squeezing said handle, the hand comprising a mid-palm composed of tendons of the index, middle and ring fingers, the mid-palm bordered outwardly (or forward) toward the fingers by knuckles which are outward of a transverse crease extending the full width of the hand, upwardly (or above) by a lower web, inwardly by the metacarpals and a portion of a lifeline contouring a thumb base, and downwardly or (below) by a tough ball with a fleshy bank adjacent the lower portion of the transverse crease, a lower tough ball at the lowest part of the hand and a fleshy heel adjacent a wrist, thence upward and outward of the fleshy heel is a bony heel, adjacent a bony lifeline (metacarpal area), directly inward of the bony heel at the wrist is a wrist hollow, and upward of the lower web is an upper web seen from the rear of the hand, the mid-palm being covered by thin skin, the web and tough ball areas covered by thicker (fatty) skin described as fleshy; exteriorly being away from the hand and interiorly being toward or pressed against the hand, the little and ring fingers and knuckles known as the lower fingers, the inner area of the hand being inward of the transverse crease, the areas below the mid-palm being the lower hand, the areas above the mid-palm being the upper hand;

a hand accessory to aid in the gripping, lifting and/or swinging of an implement handle in order to better absorb and resist the inertial force/recoil or pressure from said handle, said hand accessory receiving said inertial force from said handle reducing stress to the fingers of the gripping hand, said hand accessory augmenting force transmission from the hand to said handle, said hand accessory reducing stress received in weaker hand areas by utilizing stronger hand areas which without said hand accessory do not function or contribute to the gripping of thin handles, the hand accessory distributing the degree of force to the areas of the hand most accommodating to that degree of force, said hand accessory for optimum performance when swinging a baseball bat designed to receive and grip said handle in the outward area of the transverse crease at the mid to outer knuckle area, however said hand accessory being adaptable to all types of gripping and angles of gripping for both top and bottom hand; the gripping motion of the top hand when swinging a baseball bat without said hand accessory characterized by three discernable stages: a relaxed phase one grip with said handle located at or outward of the knuckles of the lower fingers, a phase two stage (tuck) whereby the inward area of the hand, while drawing tighter to the handle pivots outwardly but also downwardly at the knuckles (like a door on a loose hinge) thus angling the upper hand a further distance from said handle (in a "cocked position), a phase three grip (full squeeze) whereby the hand continues outward but un-cocks moving upward (the upper hand moving forward) combined with a forward/downward and somewhat interior pivoting at both the second and third joints of the thumb reducing lifeline space widthwise described as a lifeline/web narrowing, all three movements drawing the thumb closer to said handle, the final stage of said phase three grip restricted by said hand accessory limiting thumb movement toward said handle preventing bruising to the thumb, said hand accessory also producing a longer, wider hand, said hand accessory allowing movement in conjunction with the hand through a necessary range of motion in the gripping and swinging of a baseball bat, said necessary range of motion being from said phase one grip to midway of said phase three grip, said hand accessory capable of maintaining its correct position through said necessary range of motion with attachments only to the hand's little finger and thumb, the performance of said hand accessory improved however when fixed within a glove, said glove pressing certain anchoring areas further into the fleshy areas serving to relocate the fleshy areas into a more supporting position of said handle, said hand accessory comprising:

a semi-rigid, molded body having structure of varying thickness located at and in proximity to the transverse crease, said structure integrally connected extending from a thickened area below the transverse crease (below the hand) at a primary contact point upwardly thinning at the mid-palm area, still upwardly past the index knuckle then thickening to an upper web relocation press, said structure receiving direct contact and absorbing major stress at said primary contact point, said structure receiving direct contact and absorbing minimum stress in the proximity of said upper web relocation press, said structure having extensions which extend inwardly at certain areas of the hand, said extensions acting partially as levers and partially as anchors such that said extensions anchor said structure securely and leverage said structure towards said handle outwardly towards said fingers during the gripping motion, all said extensions being interconnected, said extensions being a bridge extending from said primary contact point inwardly to the hand's thumb base and wrist, a thumb/handle spacer extending from said upper web relocation press to a thumb attachment, a thumb flex extending from said mid-palm portion of said structure to a thumb attachment, said structure acting as a bridge and a wedge at its lower hand portion, said structure acting as an anchor at its mid-palm portion, said structure acting as a cushion and anchor at its upper hand portion, said structure also having a roughly ninety degree extension from said primary contact point and said bridge to the hand's tough ball area, said extension being a fulcrum platform which also wraps under glove pressure toward the rear of the hand pressing upwardly against the lower tough ball serving as an anchor and a pivoting base of said structure, said structure and extensions located in the lower hand including said primary contact point, said bridge and said fulcrum platform being a tough ball anchor, said structure and extensions located in the upper hand (said thumb flex, said thumb/handle spacer and said upper web relocation press) being an upper hand anchor, said upper hand anchor and said tough ball anchor integrally connected by a mid-palm anchor at said mid-palm portion of said structure pressing internally flush within the hand's mid-palm.

2. The hand accessory as defined in claim 1 wherein:

said mid-palm anchor connects said upper hand anchor with said tough ball anchor at such an angle as to contribute to the alignment of the hand in a phase two grip.

3. The hand accessory as defined in claim 2 wherein:

a thickened portion of said bridge being a lever, said lever extending from said primary contact point inwardly to a thumb/lifeline buffer, said lever arcing externally (convexly) from the hand, said arc reinforced largely by said ninety degree connection with said fulcrum platform, said thumb/lifeline buffer resting against the upper thumb base and wrist pressed by an external glove helping support said bridge including said arc of said lever.

4. The hand accessory as defined in claim 3 wherein:

seen internally the integral connection of said lever with said thumb/lifeline buffer being a thickened area, the lowest portion of said thickened area being a thumb base/wrist anchor pressing and anchoring at the hand's wrist hollow, said thumb base/wrist anchor thinning, extending upwardly along the wrist as a wrist anchor held snug against the wrist by external glove pressure.

5. The hand accessory as defined in claim 4 wherein:

extending forwardly from said thumb base/wrist anchor said thickened area contours the bony lifeline as a bony lifeline anchor, said bony lifeline anchor arcing internally toward said mid-palm, said internal arc reinforcing said bridge spacing the upper area of said bridge externally, said lever arcing externally widthwise from the area of said ninety degree extension from said fulcrum platform to the upper edge of said lever.

6. The hand accessory as defined in claim 5 wherein:

said upper edge of said lever being a bridge/palm angle, the innermost area of said bridge/palm angle being external to said bony lifeline anchor, said bridge/palm angle angling the upper portion of said bridge internally reversing said external bridge arcing to an internal (concave) arcing pressing against the hand's mid-palm becoming said mid-palm anchor at the area of a thumb base/lifeline anchor, a major distinction between the two areas being that during the latter stage of the gripping motion (beginning to mid phase three stage) while said bridge is still moving forwardly and downwardly said mid-palm anchor reverses moving inwardly and upwardly relative to said bridge, said mid-palm anchor remaining pressed deep within the hand's mid-palm providing anchoring and power transfer to said bridge, and contributing to said phase two angling of the hand and protection of the thumb joint.

7. The hand accessory as defined in claim 6 wherein:

said thumb base/wrist anchor being spaced a certain distance close enough to said primary contact point as to align the hand in a phase two grip, the hand "cocking" with the hand's wrist hollow moving forward (closer to the little finger knuckle) in order to "lock" into said thumb base/wrist anchor, aided by said angle of connection between said tough ball anchor and said upper hand anchor and other described structure limiting phase three completion.

8. The hand accessory as defined in claim 7 wherein:

said thumb/lifeline buffer having a balancing role of angling to allow the thumb base complete downward movement without pushing bony lifeline anchor externally out of position, yet contacting the hand's upper thumb base sufficiently to absorb enough stress so as to reduce stress to the bony lifeline area of the hand, external glove pressure against said thumb/lifeline buffer also providing a small amount of fleshy relocation "bulking" toward the lifeline area, both factors serving as a buffer against too much pressure at the bony lifeline from said thickened area of said bony lifeline anchor.

9. The hand accessory as defined in claim 8 wherein:

said bony lifeline anchor extending outwardly and extending its arcing angle interiorly along the lifeline, thinning to said thumb base/lifeline anchor being the inside edge of said mid-palm anchor pressing deep within the hand's lifeline, the contiguous area of said bony lifeline anchor and said thumb base/lifeline anchor contacting the lifeline at the extreme lowest and strongest portion of the thumb base gaining power from that area while allowing the thumb base space between said thumb/lifeline buffer and said thumb flex to move forwardly and fully downward without resisting and stressing the thumb or buckling any structure as the shortening of distance between the inner and outer area of the hand occurs.

10. The hand accessory as defined in claim 9 wherein:

said thumb base/lifeline anchor extending deeper and somewhat upwardly along the hand's lifeline becoming a lifeline/web anchor at the deepest portion of said mid-palm anchor, filling lower web not with thickened structure but by a thin, shaped structure and by flexing of said mid-palm anchor, said mid-palm anchor bending into the lifeline pressed against and moving "as one" with the mid-palm thin skin downwardly causing a slight skin movement toward the lower hand, the thin skin relocation pushing into the tough ball area creating a bulking of the tough ball improving stress absorption and support to said bridge.

11. The hand accessory as defined in claim 10 wherein:

said lifeline/web anchor extending its internal arc to a web point located at the deepest, strongest and toughest are of the hand's lower web above and adjacent the intersection of the index tendon and thumb bone and available only when the thumb remains in an open (restricted phase three) position, said lifeline/web anchor thence reversing to an external arc extending upwardly to a web relocation press located at the transverse crease at an area between the index and middle finger knuckles, said web relocation press extending upwardly along the transverse crease as a web anchor, said web anchor being a thin strip extending from said web relocation press along the transverse crease and angling slightly inward of the transverse crease resting against the hand's mid-web (between the upper web and lower web), said web anchor extending to the upper web thickening at the back side of the hand becoming said upper web relocation press.

12. The hand accessory as defined in claim 11 wherein:

said web relocation press in combination with said lifeline/web anchor pressing into and relocating the lower web upwardly and inwardly towards the thumb joint (knuckle) slightly overlapping the joint, bulking the area such that the web itself (relocated lower web) cushions and protects the sensitive thumb joint from bruising if some contact is made by said handle.

13. The hand accessory as defined in claim 11 wherein:

said upper web relocation press under glove pressure presses a fleshy portion of the hand's upper web downwardly under and in support of said web anchor such that a mid-web bulging externally under said web anchor appears from the rear as one with the upper web, the relocated upper web bulking and moving into a lower more supporting position providing said web anchor not only better bracing of said thumb/handle spacer but providing increased cushion against direct contact from the recoil of said handle at said web anchor and more power transfer to lower areas of said hand accessory.

14. The hand accessory as defined in claim 11 wherein:

said thumb attachment being a thumb/glove attachment partially encircling the thumb at the first joint, said thumb/glove attachment being a connecting area for both said thumb/handle spacer at the thumb's upper (nail) side and said thumb flex at the thumb's lower side, said thumb/handle spacer acting somewhat as a splint preventing sideways (forward) movement of the thumb (helping to eliminate full phase three grip), said thumb/hand spacer braced by said upper web relocation press and said web anchor spacing the upper area of the thumb (second joint) away from said handle preventing bruising and supplying added power transfer to the lower areas of said hand accessory through said lifeline/web anchor which is able to maintain position with no discomfort due to the open position of the thumb allowing a larger area for contact with the hand's web thus not impinging on the hand's thumb bone or index finger tendon, said thumb/glove attachment being a positioner and means of attachment to an external glove, or if fully encircled, attachment to the thumb when separate from a glove.

15. The hand accessory as defined in claim 11 wherein:

the forward side of said thumb/handle spacer being a thumb lever, said thumb lever being slightly forward of (leading) the thumb (second) joint and connecting to a thickened upper area of said thumb/glove attachment, said thumb/glove attachment and said thumb lever having some direct contact with said handle while receiving very little stress from said handle, said thumb lever wedging (leveraging) said handle forward toward the fingers especially during the phase three grip, further restricting sideways (forward) movement of the thumb adding to the success in limiting phase three grip and protecting the thumb joint.

16. The hand accessory as defined in claim 11 wherein:

said thumb flex angled to press and fix said lifeline/web anchor deep within the hand's lower web as the thumb moves downwardly during phase two grip, said thumb flex also supplying a small amount of leveraging at its upper area of connection with said mid-palm anchor outwardly against said handle toward said fingers, said thumb flex braced by said lifeline/web anchor and said web anchor combined with said thumb/handle spacer braced by said web anchor creating a tension at said thumb/glove attachment limiting the thumb's forward/internal movement and limiting the inner hand's upward/forward movement, thus restricting said phase three grip.

17. The hand accessory as defined in claim 16 wherein:

said fulcrum platform arcs upwardly against the hand's lower tough ball, said arc created partially by an upward arcing of said lever at said ninety degree extension with said fulcrum platform (as seen from a front view of the hand, not to be confused with said external arcing of said lever as seen from a bottom side view of the hand).

18. The hand accessory as defined in claim 17 wherein:

said upward arc of said fulcrum platform is increased by a thickened area of said fulcrum platform, said thickened area being a ridge located at the internal side of said fulcrum platform, said ridge pressing into the hand's lower tough ball which is the toughest most energy/stress absorbing area of the hand, said ridge aiding said fulcrum platform in anchoring said bridge and all surrounding structure.

19. The hand accessory as defined in claim 18 wherein:

said ridge pressing against the lower tough ball relocating a fleshy portion upwardly and externally in support of said bridge supporting said handle, said relocated fleshy portion known as a repositioned fleshy ridge which includes and extends from the fleshy bank roughly half way towards the wrist.

20. The hand accessory as defined in claim 19 wherein:

the interior side of said ninety degree angle extension between said fulcrum platform and said bridge and said primary contact point being a fleshy relocation channel, a hollowed area accommodating the hand's repositioned fleshy ridge, said handle and said bridge pressing the repositioned fleshy ridge downwardly overlapping said ridge into said fleshy relocation channel creating a "wider" hand allowing support of said handle to extend further below the hand creating a more powerful swing such as a hitter moving his grip lower as opposed to choking up, said fleshy relocation channel narrowing between said primary contact point and a ridge fulcrum, said narrowing causing the repositioned fleshy ridge to be blocked to a degree preventing the lower hand from moving under (forward of) said handle, giving the lower fingers a stable structure (said arcing bridge) to pull against.

21. The hand accessory as defined in claim 20 wherein:

said ridge arcing from its location of contact with the hand's lower tough ball adjacent the little finger bone upwardly (externally) to an apex and thickest area of said ridge adjacent (under) the transverse crease thence extending and thinning toward the little finger knuckle, said apex being said ridge fulcrum, said ridge fulcrum increasing support of said primary contact point, said ridge fulcrum serving as a fulcrum and pivot for said lever, said ridge fulcrum being at the lower side of said fleshy relocation channel contributing to said narrowing and said blocking to a degree of the hand's repositioned fleshy ridge.

22. The hand accessory as defined in claim 1 wherein:

said primary contact point and said fulcrum platform being integrally connected to a little finger connection below the little finger knuckle, said little finger connection curving below the little finger exteriorly (up) to be integrally joined with a little finger/glove attachment, said little finger/glove attachment partially encircling the little finger between the second and third joints as a positioner and means of attachment to an external glove or, if fully encircled, attachment to the little finger if separate from a glove.

23. The hand accessory as defined in claim 1 wherein:

said thickened area below the transverse crease (said primary contact point) having an outward edge contouring the little finger knuckle inwardly and upwardly, thinning at the lower transverse crease extending upwardly resting on the fleshy bank "locked" in the lower transverse crease by overlapping of the fleshy surface of the little finger knuckle during gripping, said structure being a knuckle lock, said knuckle lock helping to stabilize said hand accessory preventing forward movement of said tough ball anchor such that gripping pressure at said mid-palm anchor transfers to said tough ball anchor which being prevented from moving forward out of position creases a bending (downward arcing) at said primary contact point further widening the effective gripping area providing more bridging structure for said handle support, said knuckle lock also aiding in preventing said hand accessory from moving past (outward) of said handle maintaining said longer hand reducing bat roll, said knuckle lock helping maintain said lifeline/web anchor deep within the lower web helping restrict the completion of phase three grip and improve power transfer from the upper hand to said bridge.

24. The hand accessory as defined in claim 11 wherein:

said contiguous area of said bony lifeline anchor and said thumb base/lifeline anchor combined with said lifeline/web anchor serving to block forward/internal movement of the thumb at the third joint by filling the hand's lifeline reducing said lifeline/web narrowing, providing more fleshy area to be contacted within the lower web and lifeline, and spacing the thumb a further distance from said handle, thus contributing to said hand accessory producing said necessary range of motion of the hand.

25. In combination with a handle of an implement when said handle is to be manually swung in motion by the hand of a human with the hand gripping and squeezing said handle, the hand having a mid-palm, knuckles and fingers, the mid-palm bordered outwardly directly adjacent the knuckles by a transverse crease extending the width of the hand, upwardly (above) by a lower web, inwardly by the metacarpals and a lifeline contouring a thumb base, downwardly (below) by a tough ball directly adjacent the transverse crease and a lower tough ball at the lowest part of the hand, a fleshy heel directly adjacent a wrist, thence upward and outward of the fleshy heel lie a bony heel and bony lifeline, inward of the bony heel at the wrist is a wrist hollow, above the lower web is an upper web seen from the rear of the hand, the area of the hand inward of the transverse crease being the inner hand, the area below the mid-palm being the lower hand and the area above being the upper hand;

a hand accessory being a semi-rigid, molded body structured to flex in certain areas allowing movement of a human hand in a necessary range of motion when gripping any thin handle, said hand accessory designed to receive and dissipate stress from the pressure of said handle to a bridge, said bridge arcing externally above the tough ball and arcing internally against the mid-palm and lower web, a portion of said bridge receiving initial direct contact with said handle being a primary contact point, said primary contact point serving to widen the effective grip of the hand, said primary contact point extending from an area lower than the hand's lower tough ball and adjacent the little finger knuckle, contouring a lower portion of the little finger knuckle thence extending upwardly as said bridge extending to the mid-palm anchoring in the hand's mid-palm and lower web, said anchor in the lower web being a lifeline/web anchor, said lifeline/web anchor being in a bracing position interiorly of and adjacent the upper area of said bridge providing a partial support to said bridge above the hand's metacarpals, the angle of attachment of said bridge to said lifeline/web anchor creating a bending and bulging of said lifeline/web anchor pressing deep within an upper portion of the lifeline and lower web.

26. The hand accessory as defined in claim 25 wherein:

said lifeline/web anchor extending upwardly to an upper hand anchor, said upper hand anchor encircling the web in a rectangular shape with the lower side of said rectangle integrally attached to said lifeline/web anchor, the outward side of said attachment being a web/relocation press, said outward side extending from said web relocation press as a thin strip along the transverse crease to the upper web, said thin strip being a web anchor, the inner side of said attachment contouring the thumb base extending upwardly along the forward area of the thumb to the upper area of the thumb adjacent the thumb first joint as a thumb flex, thence paralleling the thumb which is braced in an open position by the combined structure a thumb/handle spacer extending to the upper web at the rear of the hand connecting to said web anchor anchoring at the upper web as an upper web relocation press, such that the largest area of said upper hand anchor is an open space allowing said necessary range of motion, preventing buckling of structure, and aligning the thumb in an open position, said necessary range of motion allowing full inner hand and thumb third joint downward movement, said necessary range of motion restricting thumb second joint and inner hand forward/upward movement.

27. The hand accessory as defined in claim 26 wherein:

said lifeline/web anchor in combination with said upper hand anchor pressing into the hand's lower and upper web creating a relocation, bulking and compaction of fleshy area providing a denser area for energy absorption against a weighted or recoiling handle.

28. The hand accessory as defined in claim 27 wherein:

said lifeline/web anchor combined with said web relocation press pressing deep into the lower web creating a fleshy displacement (relocated lower web) upwardly and inwardly against and partially overlapping the thumb joint protecting the thumb joint and thumb bone from bruising.

29. The hand accessory as defined in claim 28 wherein:

said upper web relocation press pressing into the upper web with assistance of an external glove displacing the fleshy upper web (relocated upper web) downwardly under said web anchor proving better cushioning against the stress of direct contact with a handle and providing stronger bracing of said thumb/handle spacer maintaining the thumb in said open position contributing to said necessary range of motion.

* * * * *